US007354295B2

(12) United States Patent
Tashiro et al.

(10) Patent No.: US 7,354,295 B2
(45) Date of Patent: Apr. 8, 2008

(54) TERMINAL AND CONNECTOR

(75) Inventors: Harunori Tashiro, Haibara-gun (JP); Masaru Fukuda, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 616 days.

(21) Appl. No.: 10/691,979

(22) Filed: Oct. 24, 2003

(65) Prior Publication Data

US 2006/0172585 A1 Aug. 3, 2006

(30) Foreign Application Priority Data

Oct. 25, 2002 (JP) ..... P.2002-311478
Nov. 14, 2002 (JP) ..... P.2002-331160

(51) Int. Cl.
*H01R 4/24* (2006.01)

(52) U.S. Cl. ..... 439/397; 439/404

(58) Field of Classification Search ..... 439/395, 439/396, 398, 399, 400, 401, 402, 403, 404, 439/405, 417
See application file for complete search history.

(56) References Cited

U.S. PATENT DOCUMENTS 4,464,002 A * 8/1984 Suzuki et al. ..... 439/397
4,560,226 A 12/1985 Dennis
4,654,580 A 3/1987 Keller
5,669,792 A 9/1997 Naka et al.
6,190,203 B1 * 2/2001 Murakami et al. ..... 439/587
6,296,513 B1 * 10/2001 Ishikawa et al. ..... 439/403
6,312,288 B1 * 11/2001 Genz et al. ..... 439/628
6,475,018 B1 * 11/2002 Huang ..... 439/397
6,506,072 B2 * 1/2003 Nimura ..... 439/405
6,969,272 B2 * 11/2005 Sakamoto et al. ..... 439/397

FOREIGN PATENT DOCUMENTS

DE 81 07 135 U1 8/1981
DE 102 14 901 A1 10/2003
JP 2-115257 U 9/1990
JP 7-226279 A 8/1995
JP 8-339866 A 12/1996

(Continued)

*Primary Examiner*—Thanh-Tam Le
(74) *Attorney, Agent, or Firm*—Sughrue Mion, PLLC

(57) ABSTRACT

A connector includes a plurality of terminals and a connector housing, receiving the terminals. Each of the terminals includes a terminal connecting portion, having a tubular shape, and receiving a mating terminal, a wire press-contacting portion including a press-contacting blade for press-contacting a wire, and the press-contacting blade having a blade width larger than a width of the terminal connecting portion, and an interconnecting portion, connecting the terminal connection portion and a wire press-contacting portion. A press-contacting direction in which the wire is press-contacted with the wire press-contacting portion is parallel to a terminal fitting direction of the terminal connecting portion. The terminal connecting portions of the terminals are received in the connector housing in parallel so that the press-contacting blades are arranged in a staggered manner.

Also, a connector includes a housing and a terminal received in the housing. The terminal includes a wire connecting portion which connects a wire and an extension portion which is extended from the wire connecting portion. The extension portion has a conductive portion which is formed in a direction intersecting a direction in which the terminal is inserted into the housing. The housing has an exposure hole through which at least part of the conductive portion is exposed to an exterior.

7 Claims, 24 Drawing Sheets

FOREIGN PATENT DOCUMENTS

| | | | |
|---|---|---|---|
| JP | 9-129297 | A | 5/1997 |
| JP | 9-161857 | A | 6/1997 |
| JP | 10-134861 | A | 5/1998 |
| JP | 10-294138 | A | 11/1998 |
| JP | 11-191443 | A | 7/1999 |
| JP | 11-204227 | A | 7/1999 |
| JP | 11-260441 | A | 9/1999 |
| JP | 2001-35556 | A | 2/2001 |
| JP | 2002-184481 | A | 6/2002 |
| JP | 2002-260747 | A | 9/2002 |

* cited by examiner

TERMINAL AND CONNECTOR

BACKGROUND OF THE INVENTION

This invention relates to a terminal and a connector, and more particularly to an improved press-contacting terminal having a wire press-contacting portion with which a wire is press-contacted in such a manner that the wire extends in a direction perpendicular to a terminal fitting direction.

Also, this invention relates to a connector having a housing in which a plurality of terminals, connected respectively to wires, are received, and more particularly to such a connector in which an electrical connection of each terminal can be checked by bringing a probe of a tester into contact with the terminal from the outside of the housing.

One related press-contacting metal terminal is formed by cutting and bending an electrically-conductive metal sheet, and this metal terminal has a narrow, elongated box-like body having a uniform width over an entire length thereof (see, for example, JP-A-10-294138, especially, pages 2 and 3, FIG. 1).

As shown in FIG. 23, a front portion (left-side portion in FIG. 23) of such a press-contacting metal terminal 100 is formed into a terminal connecting portion 110 for connection to a mating metal terminal, while a rear portion thereof (right-side portion in FIG. 23) is formed into a wire press-contacting portion 120 with which a wire D can be press-contacted.

The terminal connecting portion 110 is formed by winding a relevant portion of a metal sheet into a rectangular tubular shape having four corner portions 111, with end portions of this metal sheet portion superposed together at a top wall portion of this terminal connecting portion. A resilient contact piece portion 112 for resilient contact with a mating connection metal terminal is provided within this terminal connecting portion.

The wire press-contacting portion 120 is also formed by winding a relevant portion of the metal sheet into a rectangular tubular shape having four corner portions 121. Grooves 123 are formed respectively in rear end portions of upper and lower plates 122U and 122L to respectively provide a pair of press-contacting blades 124 with which the wire D can be press-contacted. A blade width of the pair of press-contacting blades 124 is generally equal to the width of the rectangular tubular body.

There is known a related press-contacting connector which includes a plurality of press-contacting metal terminals as described above, and a connector housing for receiving these press-contacting metal terminals (see, for example, JP-A-11-191443, especially, pages 2 and 3, FIG. 8.

As shown in FIG. 24, such a press-contacting connector 130 includes a plurality of press-contacting metal terminals 100 as described above, and a connector housing 140 for receiving the press-contacting metal terminals 100.

The connector housing 140 includes a plurality of terminal receiving chambers 141 for respectively receiving the press-contacting metal terminals 140 in a juxtaposed manner. Reception portions 142*a* and 142*b* are formed within each terminal receiving chamber 141, and are disposed at a generally central portion of the terminal receiving chamber 141 in a terminal inserting direction (in a left-hand direction in FIG. 24).

When the wire D is press-contacted with the pair of press-contacting blades 124 of the press-contacting metal terminal 100 inserted in the terminal receiving chamber 141, abutment portions 101*a* and 101*b*, formed respectively at the upper and lower plates 122U and 122L of the press-contacting metal terminal 100, are brought into abutting engagement with the reception portions 142*a* and 142*b*, respectively, so that a pushing force is received.

Therefore, the deformation of the press-contacting metal terminal 100 is prevented as compared with the case where such a pushing force is received by a front end portion of a press-contacting metal terminal.

In recent years, with a compact design of electrical parts, a compact design of the press-contacting metal terminal 100 as well as a compact design of the press-contacting connector 130 has been desired. However, the blade width of the pair of press-contacting blades 124 is equal to the width of the press-contacting metal terminal 100 as described above, and the compact design is limited in connection with the size of the wire D to be press-contacted with the press-contacting metal terminal.

And besides, there is encountered a problem that the strength of the press-contacting blades decreases with the compact design of the press-contacting metal terminal, so that the press-contacting force is lowered.

Furthermore, when forming the press-contacting metal terminal 100 having the box-like shape as described above, those portions of the metal sheet which are to be formed respectively into the corner portions 121 are integrally bent in parallel relation to the adjacent grooves 123, so that the grooves 123 are spread, which invites a problem that the precision of working of the press-contacting blades 124 is lowered.

In the press-contacting connector 130, when the wire D is press-contacted with the pair of press-contacting blades 124, the abutment portions 101*a* and 101*b* of the press-contacting metal terminal 100 abut respectively against the reception portions 142*a* and 142*b* of the connector housing 140, and are supported by them, respectively. However, the thickness of the abutment portions 101*a* and 101*b* can only be made equal to or about twice larger than the sheet thickness, and therefore there is a possibility that upon application of the pushing force, the abutment portions 101*a* and 101*b* cut into the reception portions 142*a* and 142*b*, respectively, so that the connector housing 140 is subjected to chipping, deformation or the like.

Also, heretofore, electrical parts, electrical devices, control boards, etc., mounted on a vehicle or the like in spaced relation to each other, are electrically connected by a wire harness including a plurality of wire groups in which predetermined connectors are beforehand attached to predetermined ones of these wires.

In such a wire harness, when a trouble develops in any of the connectors, this connector, together with its outwardly-extending wires, is cut off from the wire harness, and an exchange-purpose connector, having wires beforehand extended outwardly therefrom, is used, in which case the wires of the exchange-purpose connector are connected respectively to corresponding wires of the wire harness, thereby achieving the recovery. In such a case, it is necessary to confirm whether or not the original wires of the wire harness are properly connected respectively to the wires of the exchange-purpose connector.

In recent years, with the use of an increased number of electrical parts and control circuits, there is a tendency for connectors to receive an increased number of terminals therein, and the receiving density increases, and therefore a strict dimensional control has now been imposed on the terminals.

Therefore, for example, when checking an electrical connection of the terminal, it is necessary to avoid bringing a probe of a tester into direct contact with an electrical contact portion of the terminal. Therefore, there has been proposed the type of connector in which an electrical connection of each terminal can be checked without bringing such a probe into contact with the electrical contact portion.

In a connector 201 shown in FIG. 25, detection holes 209, corresponding respectively to cavities 207, are formed through a rear portion of a lower wall 205 of a housing 203. A lower metal wall (lower surface plate) 213 of each press-contacting terminal 211 is opposed to the corresponding detection hole 209, and the inner side of the detection hole 9 is closed by the lower surface plate 213 of the press-contacting terminal 211.

In this connector 201, a tester rod T can be inserted into the detection hole 209 in the housing 203, and can be brought into abutting engagement with the lower surface plate 213 of the press-contacting terminal 211 for checking an electrical connection of the terminal (refer to JP-A-11-204227).

In many cases, connectors, used for a wire harness, are molded of a resin material since in addition to insulating properties, an impact resistance, moldability and a light-weight design can be obtained. Therefore, there are occasions when the configuration of the connector is limited by the direction of removal of the molded connector from a mold.

The direction of connection of the above related connector 201 to a mating connector and the direction of insertion of the terminals into the connector 101 coincide with each other, that is, are the same direction indicated by arrow "a" in FIG. 25. Therefore, the direction of removal of the connector from the mold is the same direction "a".

In the above connector, however, the detection holes 9, corresponding respectively to the cavities, are formed through the wall in a direction perpendicular to the mold-removing direction. Therefore, because of its structure, the mold need to include a slide mold, and therefore is complicated in structure. As a result, there was a disadvantage that the cost of the mold increased.

To deal with this problem, for example, the provision of the detection holes was omitted, and a tester rod was inserted through a wire lead-out hole in the rear end of the connector, and was brought into abutting engagement with the metal terminal so as to effect an electrical connection check. In this case, however, the wire interfered with the tester rod, and therefore the operation was difficult.

Particularly when each wire was bent into a crank-shape at the wire lead-out hole by an attached cover as in the connector of FIG. 25, the test rod could not be inserted into the wire lead-out hole, and therefore must be inserted into a cavity opening formed in the front end of the connector, and as a result there was a fear that the terminal was damaged.

SUMMARY OF THE INVENTION

It is therefore an object of the present invention to provide a compact design of a press-contacting metal terminal and a compact design of a press-contacting connector and also to provide the good press-contacting metal terminal and press-contacting connector, in which the reliability of the press-contacting connection is enhanced.

Also, an another object of the present invention is to provide a connector in which a housing, having holes for the purpose of an electrical connection check, can be molded by the use of a mold of a simple structure, so that the cost of the mold can be made low.

In order to achieve the above object, according to the present invention, there is provided a terminal, comprising:

a terminal connecting portion, having a tubular shape, and receiving a mating terminal;

a wire press-contacting portion, including a press-contacting blade for press-contacting a wire, and the press-contacting blade having a blade width larger than a width of the terminal connecting portion; and an interconnecting portion, connecting the terminal connection portion and a wire press-contacting portion, wherein a press-contacting direction in which the wire is press-contacted with the wire press-contacting portion is parallel to a terminal fitting direction of the terminal connecting portion.

In the above configuration, the wire press-contacting portion has the press-contacting blade having the blade width larger than the width of the terminal connecting portion, and therefore even when the terminal connecting portion is formed into a compact design as a result of forming the press-contacting terminal into a compact design, the reliability of the press-contacting connection by the press-contacting blade will not be lowered.

The press-contacting blade of the press-contacting terminal, which is connected by the interconnecting portion to the terminal connecting portion in parallel relation thereto, is formed independently of the terminal connecting portion.

Therefore, the precision of working of the press-contacting blade will not be lowered by the influence of the terminal connecting portion-forming operation.

Preferably, the interconnecting portion has a press-contact receiving face for receiving a press-contacting force acting on the press-contacting blade. The press-contact receiving face abuts against an inner wall of a connector housing so that the press-contacting force is received by the inner wall of the connector housing through the press-contact receiving face when the wire is press-contacted with the press-contacting blade. Here, it is preferable that, the press-contact receiving face is formed at a rear side of the press-contacting blade.

In the above configuration, the press-contacting force for press-contacting the wire with the press-contacting blade is received by the inner wall of the connector housing through the press-contact receiving face formed at the rear side of the press-contacting blade.

Therefore, the bearing pressure of the press-contacting terminal, acting on the inner wall of the connector housing during the press-contacting operation, can be reduced, and the chipping and deformation of the connector housing are prevented. And besides, the press-contacting force will not act on the terminal connecting portion, and therefore the terminal connecting portion is prevented from deformation.

Preferably, the press-contacting blade is formed by a flat plate having a groove with which the wire is press-contacted.

Preferably, the wire press-contacting portion is spaced a prescribed distance from the terminal connecting portion in a direction perpendicular to the press-contacting direction.

According to the present invention, there is also provided a connector, comprising:

a plurality of terminals; and a connector housing, receiving the terminals, each of the terminals, including:

a terminal connecting portion, having a tubular shape, and receiving a mating terminal;

a wire press-contacting portion, including a press-contacting blade for press-contacting a wire, and the press-contacting blade having a blade width larger than a width of the terminal connecting portion; and an interconnecting portion, connecting the terminal connection portion and a wire press-contacting portion, wherein a press-contacting direction in which the wire is press-contacted with the wire press-contacting portion is parallel to a terminal fitting direction of the terminal connecting portion; and wherein the terminal connecting portions of the terminals are received in the connector housing in parallel so that the press-contacting blades are arranged in a staggered manner.

In the above configuration, the terminal connecting portions of the plurality of press-contacting terminals (each having the wire press-contacting portion and the terminal connecting portion which are interconnected by the interconnecting portion in such a manner that the press-contacting direction of the wire press-contacting portion is parallel to the terminal fitting direction of the terminal connecting portion) are received in the connector housing in such a juxtaposed manner that the press-contacting blades of the press-contacting terminals are arranged in a staggered manner. Therefore, even in the case where the terminal connecting portions of the press-contacting terminals are received in the connector housing in juxtaposed, closely-spaced relation to one another, the adjacent press-contacting blades are prevented from interfering with each other.

Therefore, the blade width of the press-contacting blades can be increased so as to increase the strength thereof without increasing the pitch of the juxtaposed press-contacting terminals. And besides, the connector housing can be formed into a compact design by reducing the pitch of the juxtaposed press-contacting terminals, so that the press-contacting connector can be formed into the compact design.

Preferably, the interconnecting portion has a press-contact receiving face which abuts against an inner wall of the connector housing so that a press-contacting force acting on the press-contacting blade is received by the inner wall of the connector housing when the wire is press-contacted with the press-contacting blade. The connector housing has a support jig-inserting portion into which a support jig for receiving the press-contacting force through the inner face of the connector housing is inserted.

In the above configuration, the press-contacting force, supported through the press-contact receiving face formed, is received by the support jig inserted in the support jig-inserting portion of the connector housing. Therefore, the connector housing and the terminal are prevented from being deformed during the press-contacting operation, and besides the wire can be easily and positively press-contacted with the press-contacting blade.

According to the present invention, there is also provided a connector, comprising:

a housing; and a terminal, received in the housing, and having a wire connecting portion which connects a wire and an extension portion which is extended from the wire connecting portion, wherein the extension portion has a conductive portion which is formed in a direction intersecting a direction in which the terminal is inserted into the housing; and wherein the housing has an exposure hole through which at least part of the conductive portion is exposed to an exterior.

Here, one example of the connector housing is molded of a synthetic resin, and a plurality of terminal receiving chambers (division sections) for respectively receiving the terminals are formed within the housing.

One example of the terminal is a press-contacting terminal which includes an electrical contact portion formed at a front end thereof, and the press-contacting portion at a rear end thereof. One example of the conductive portion is an upstanding piece portion which is bent perpendicularly relative to the extension portion extending between the electrical contact portion and the press-contacting portion.

In the above configuration, the terminal has the conductive portion formed, for example, projecting in an upstanding manner in the direction intersecting the direction of insertion of the terminal, and therefore the exposure hole (that is, an opening or hole for the purpose of an electrical connection check) for exposing the conductive portion can be formed in the direction of removal of a mold. Therefore, there is no need to use a complicated mold with a slide mold or the like as used in the related construction in which the holes for checking the electrical connection are formed in the direction perpendicular to the direction of removal of the mold, and therefore the structure of the mold can be simplified, so that the cost of the mold can be made low.

Therefore, this connector solves the problems of the related construction, that is, the complicated structure of the mold and the increased cost of the mold.

Preferably, the exposure hole is open in a direction in which the housing is fitted into a mating housing.

In the above configuration, a probe of a tester and the terminal to be checked for its electrical connection can be viewed from the same direction at a position close to them, and the failure to direct the probe to the proper terminal to be checked for its electrical connection hardly occurs, so that the electrical connection check can be effected easily.

Preferably, the conductive portion is electrically connected to the wire through the wire connecting portion.

Preferably, the connector the extension portion is comprised of a conductive plate. The conductive portion is formed by folding the conductive plate.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A first embodiment of a press-contacting metal terminal and a press-contacting connector of the invention, will now be described in detail with reference to the accompanying drawings.

Figure 1:
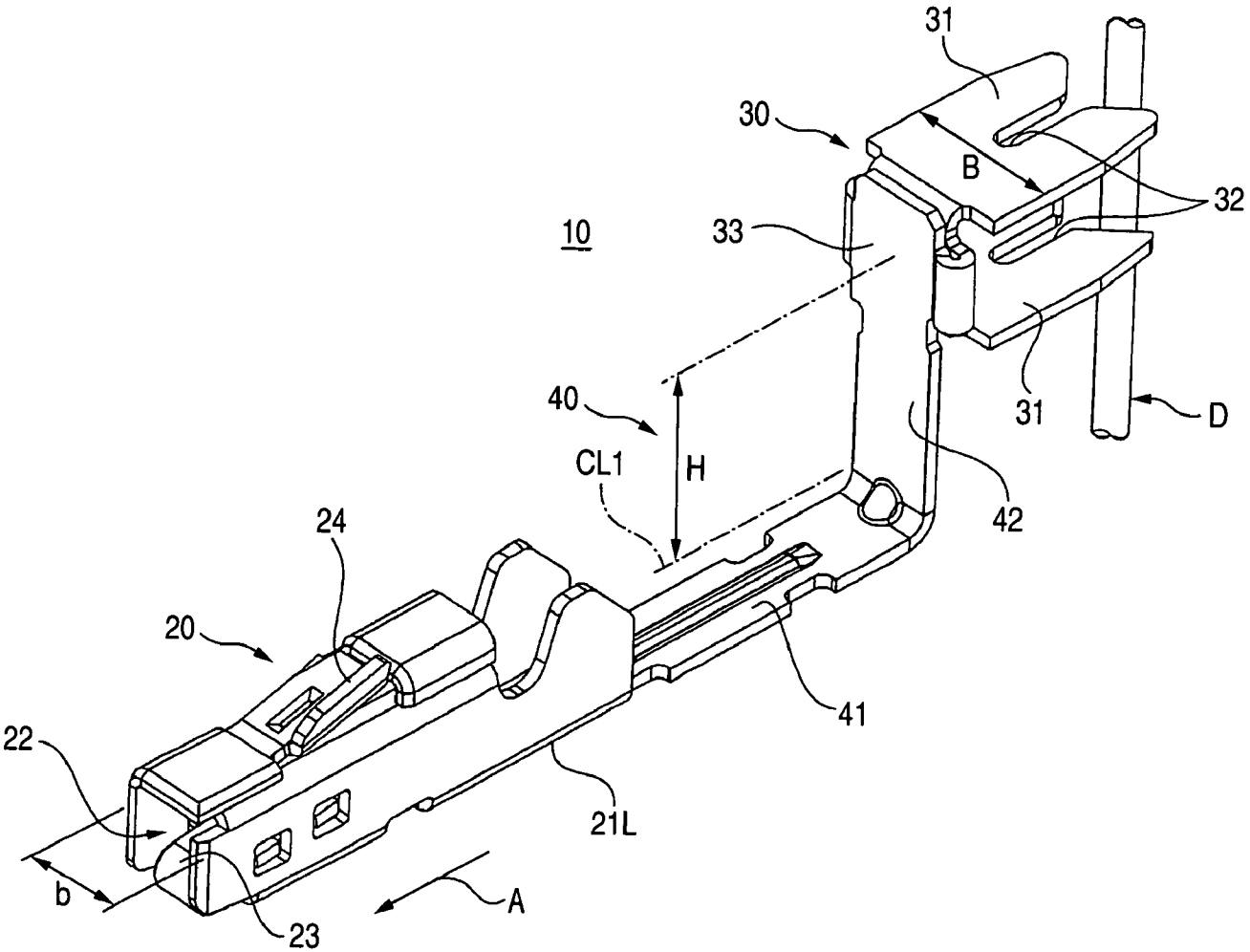
FIG. 1 is a perspective view showing the whole of a first embodiment of a press-contacting metal terminal of the invention.
Figure 2:
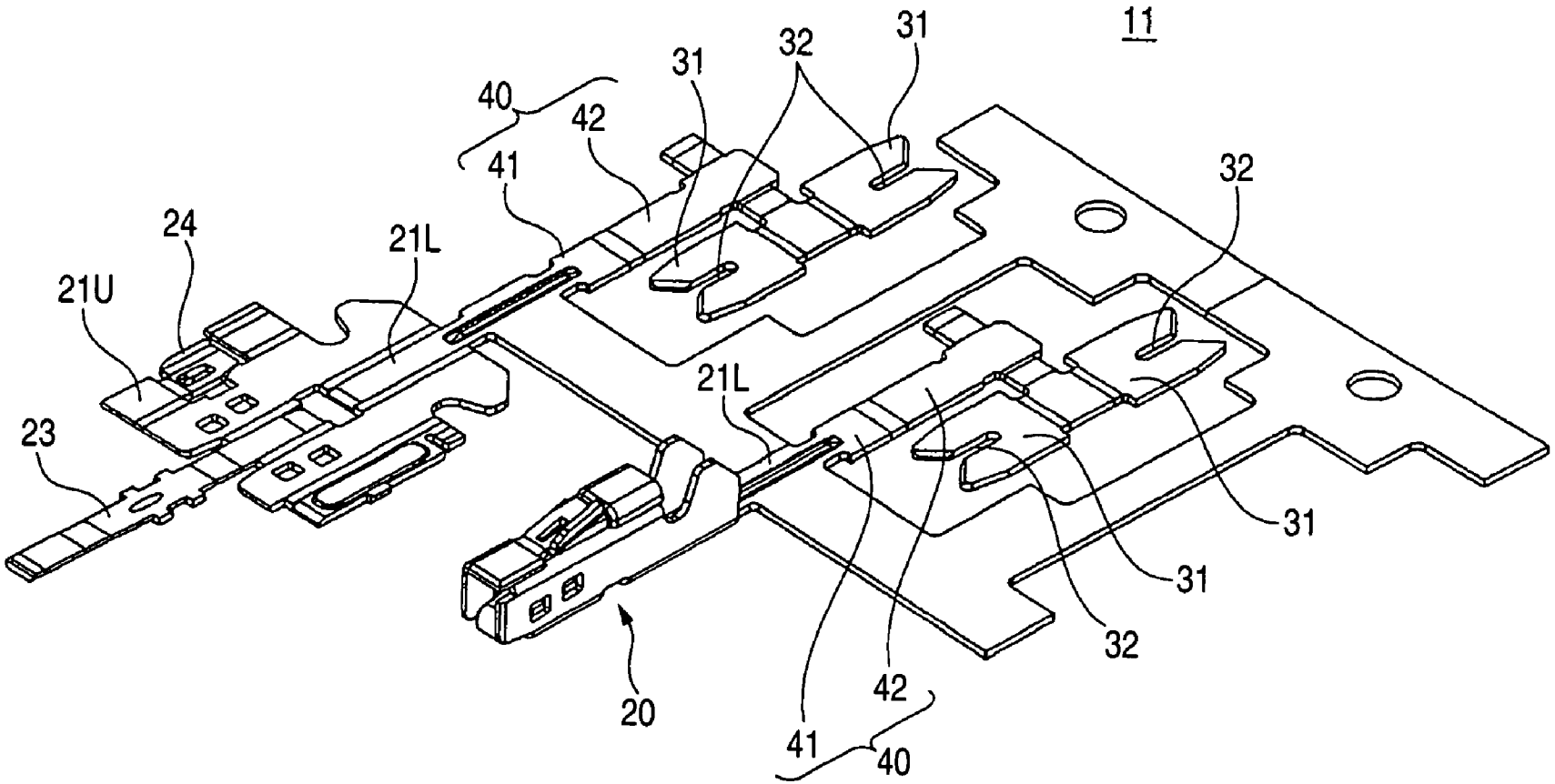
FIG. 2 is a developed view of the press-contacting metal terminal of FIG. 1.

FIG. 1 is a perspective view showing the whole of the first embodiment of the press-contacting metal terminal of the invention, and FIG. 2 is a developed view of the press-contacting metal terminal of FIG. 1.

As shown in FIG. 1, the press-contacting metal terminal 10 of this embodiment includes a terminal connecting portion 20 of a tubular shape formed at one end of a base plate 21L formed of an electrically-conductive metal sheet, and a wire press-contacting portion 30 formed at the other end of the base plate 21L, and a wire D can be press-contacted with this wire press-contacting portion 30 in such a manner that the wire D extends in a direction perpendicular to a terminal fitting direction (in a direction of arrow A in FIG. 1).

The wire press-contacting portion 30 and the terminal connecting portion 20 are interconnected by an interconnecting portion 40 in such a manner that the press-contacting direction of the wire press-contacting portion 30 is parallel to the terminal fitting direction of the terminal connecting portion 20.

Referring to FIGS. 1 and 2, the terminal connecting portion 20 is formed by blanking a sheet piece from an electrically-conductive metal sheet (sheet material) 11 and then by bending this sheet piece into a tubular body of a rectangular cross-section having a superposed upper plate 21U. A mating terminal is inserted into an internal space 22 within this terminal connecting portion 20.

In order to positively electrically connect this metal terminal to the mating terminal, there is provided a resilient contact piece portion 23 (which can be resiliently deformed) which is folded back, and is disposed within the internal space 22. A resiliently-deformable lock piece portion 24 is formed on the upper plate 21U, and when the metal terminal is inserted in a connector housing 60 (see FIG. 4) described later, this lock piece portion 24 prevents the withdrawal of the metal terminal.

The interconnecting portion 40 has an L-shape, and includes a horizontal portion 41 formed integrally with and extending from the base plate 21L of the terminal connecting portion 20, and a vertical portion 42 extending vertically upwardly from a rear end of this horizontal portion 41. The wire press-contacting portion 30 is formed integrally at an upper end of the vertical portion 42.

Therefore, the press-contacting direction of the wire press-contacting portion 30 is parallel to the terminal fitting direction of the terminal connecting portion 20, and the wire press-contacting portion 30 is spaced a predetermined distance H from a centerline (axis) CL1 of the terminal connecting portion 20.

The interconnecting portion 40 can be shaped to have only the vertical portion extending vertically upwardly from the rear end of the base plate 21L of the terminal connecting portion 20.

Two (upper and lower) flat plate-like press-contacting blades 31 are formed at the wire press-contacting portion 30, and a groove 32 for press-contacting with the wire D is formed in a widthwise-central portion of each press-contacting blade 31.

A blade width "B" of the press-contacting blades 31 is larger than a width "b" of the terminal connecting portion 20, and a sufficient strength of the press-contacting blade 31 is secured so that a sufficient press-contacting force can be obtained.

A press-contact receiving face 33 is formed at a rear side (left side in FIG. 1) of the press-contacting blades 31, and when the wire D is press-contacted with the press-contacting blades 31, this press-contact receiving face 33 abuts against an inner wall of the connector housing so that a press-contacting force, acting on the press-contacting blades 31, can be supported by the inner wall of the connector housing.

In the press-contacting metal terminal 10 of this embodiment, the wire press-contacting portion 30 has the press-contacting blades 31 having the blade width "B" larger than the width "b" of the terminal connecting portion 20. Therefore, when the terminal connecting portion 20 is formed into a compact design as a result of a compact design of the press-contacting metal terminal 10, the reliability of the press-contacting connection by the press-contacting blades 31 will not be lowered.

The press-contacting blades 31 of the wire press-contacting portion 30, connected by the interconnecting portion 40 to the terminal connecting portion 20 in parallel relation thereto, are formed independently of the terminal connecting portion 20.

Namely, when the blanking of the sheet material 11 is effected in such a manner that the grooves 32, formed respectively in the press-contacting blades 31, are spaced a predetermined distance from the terminal connecting portion 20, these grooves 32 will not be influenced at the time of forming the terminal connecting portion 20 by a bending operation at a later stage. And besides, when bending the pair of press-contacting blades 31, any portion is not bent in parallel relation to the grooves 32, and therefore the lowered working precision of the press-contacting blades 31, such as the spreading of the grooves 32, will not occur.

Next, the first embodiment of the press-contacting connector of the invention will be described in detail with reference to the accompanying drawings.

Figure 3:
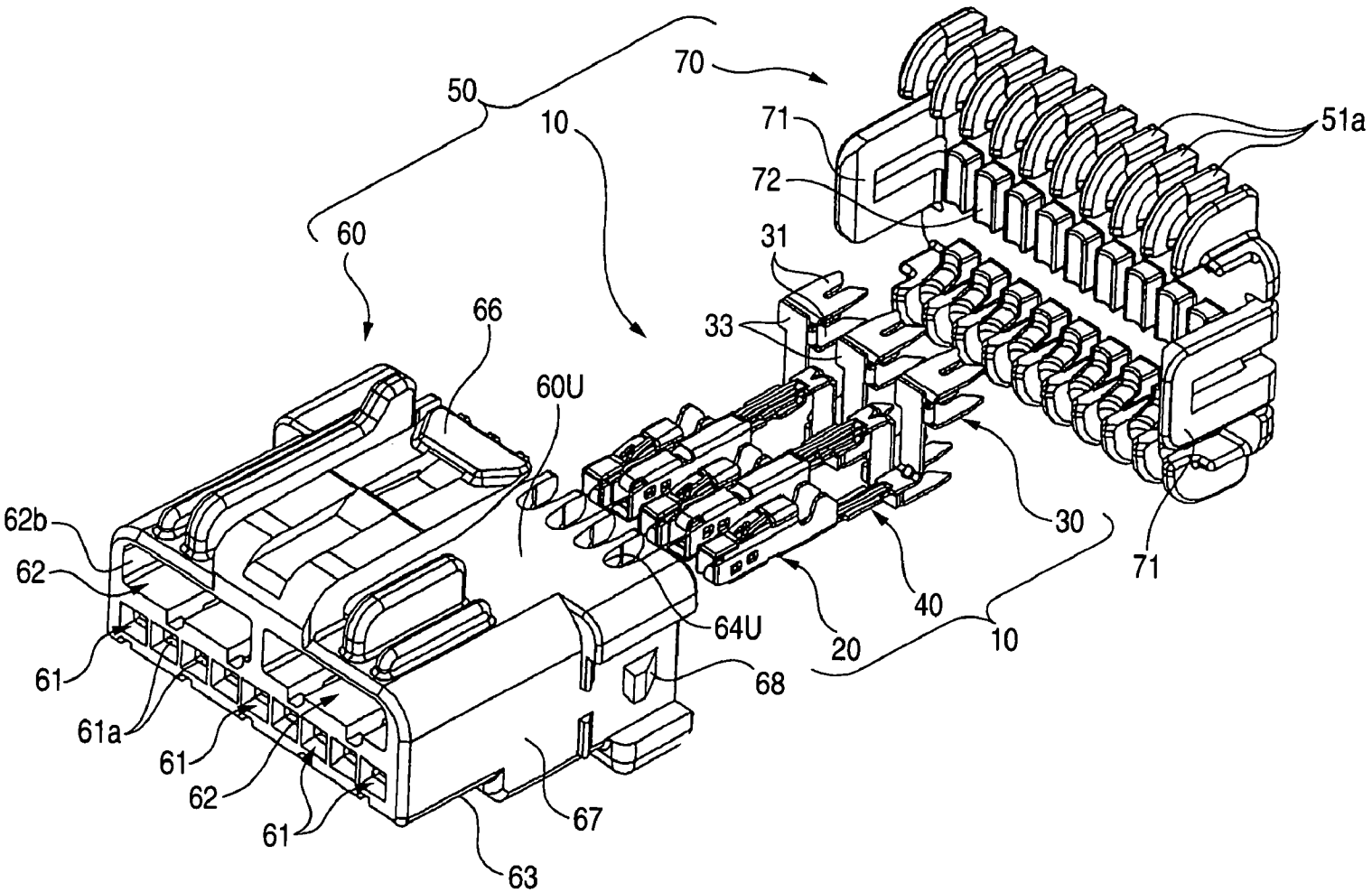
FIG. 3 is an exploded, perspective view of the first embodiment of a press-contacting connector of the invention as seen from the front side thereof.
Figure 4:
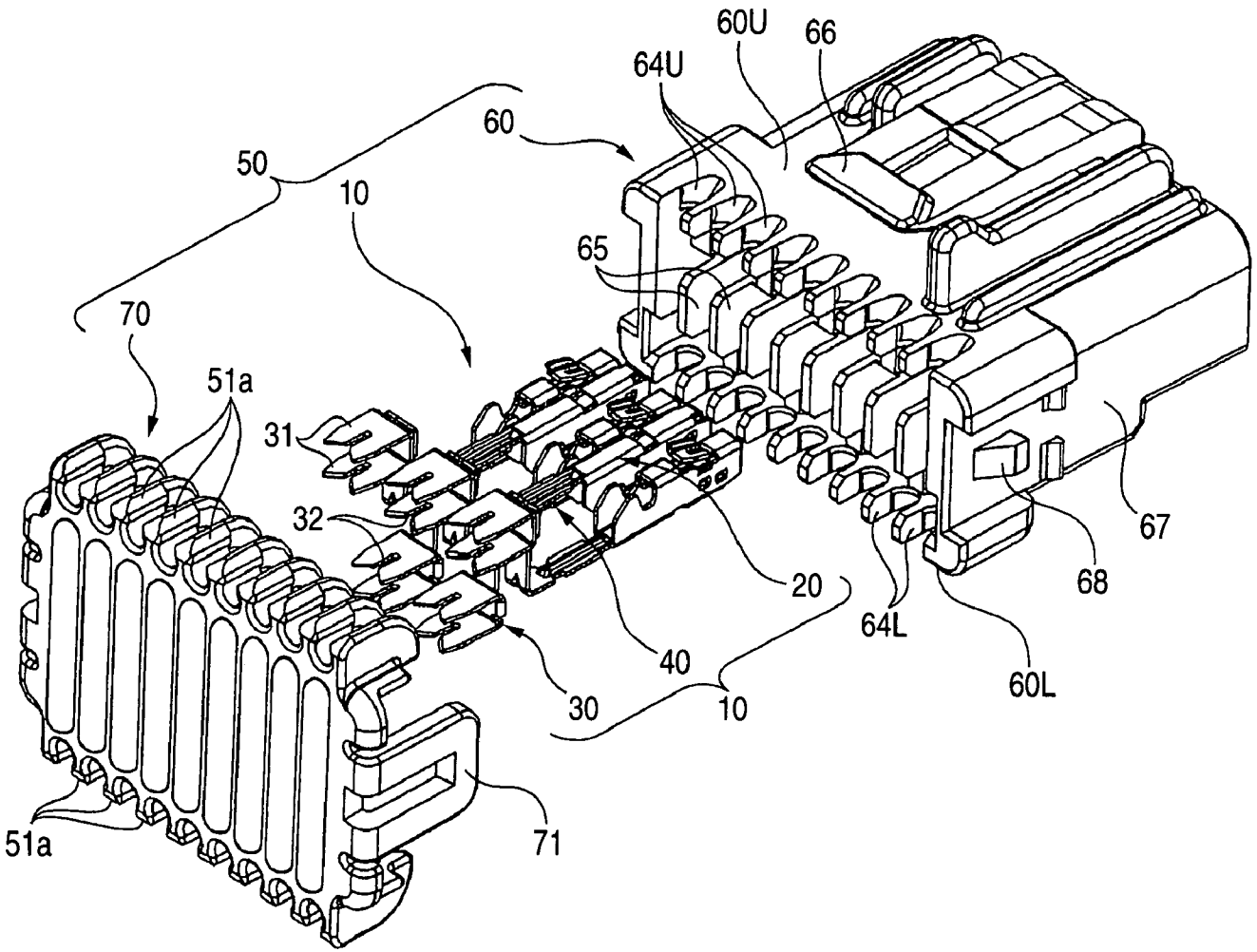
FIG. 4 is an exploded, perspective view of the press-contacting connector of FIG. 3 as seen from the rear side thereof.

FIG. 3 and 4 are exploded, perspective views of the first embodiment of the press-contacting connector of the invention as seen respectively from the front side and the rear side.

As shown in FIGS. 3 and 4, the press-contacting connector 50 of this embodiment includes the connector housing 60 for receiving the terminal connecting portions 20 of a plurality of the press-contacting metal terminals 10 in such a juxtaposed manner that the pairs of press-contacting blades 31 of the press-contacting metal terminals 10 are arranged in a staggered manner, and a cover 70 attached to a rear end of the connector housing 60 to cover those portions of the wires D press-contacted with the press-contacting blades 31.

The connector housing 60 of a generally rectangular parallelepiped shape is made of an insulative resin, and a plurality of terminal receiving chambers 61 for respectively receiving the terminal connecting portions 20 of the plurality of press-contacting metal terminals 10 in a juxtaposed manner are formed in a lower section of an internal space of this connector housing. Terminal insertion ports 61 a are formed in a front surface (left side surface in FIG. 3) of the connector housing, and mating terminals are inserted into these terminal insertion ports 61*a*, respectively.

Support portion-inserting portions 62 (serving as a support jig-inserting portion) for receiving a support jig 80 (see FIG. 9) described later are formed in an upper section of the internal space of the connector housing 60. Support portion-inserting ports 62*b* for the insertion of support portions 82*a* of the support jig 80 therethrough are formed in the front surface of the connector housing.

A support portion-sliding surface 63 (serving as a support jig-inserting portion) for guiding a sliding movement of a support portion 82*b* of the support jig 80 is formed on a lower surface of the connector housing 60.

A plurality of juxtaposed guide recesses 64U are formed in a rear end (left end in FIG. 4) of a top plate 60U of the connector housing 60, while a plurality of juxtaposed guide recesses 64L are formed in a rear end (left end in FIG. 4) of a bottom plate 60L of the connector housing, and theses recesses 64U and 64L guide and hold the insulated conductors (wires) D extending vertically. Partition walls 65 for separating the plurality of wires D from one another are formed at the rear end surface of the connector housing 60, and are disposed between the row of upper guide recesses 64U and the row of lower guide recesses 64L, and extend vertically.

An elastically-deformable lock arm 66 is formed on an upper surface of the top plate 60U of the connector housing 60, and when the press-contacting connector 50 is attached to a mating connector portion such for example as an electric box, this lock arm 66 prevents the connector 50 from being disengaged from the mating connector portion. Retaining projections 68 are formed respectively on outer surfaces of opposite side plates 67 of the connector housing 60, and when the cover 70 is attached to the connector housing, these retaining projections 68 retain the cover 70.

As shown in FIGS. 3 and 4, the cover 70 has a generally flat plate-like shape, and lock arms 71 are formed on and project respectively from right and left sides of this cover. These lock arms 71 are retainingly engaged respectively with the retaining projections 68 of the connector housing 60, thereby preventing the cover 70 from being disengaged from the connector housing 60.

Guide ribs 51*a*, corresponding to the guide recesses 64U, are formed in an upper surface of the cover 70 so as to guide the wires D rearwardly, while guide ribs 51*a*, corresponding to the guide recesses 64L, are formed in a lower surface of the cover 70 so as to guide the wires D rearwardly, these guide ribs 51 a extending in the forward-rearward direction. Pressing projections 72 for respectively pressing the insulated conductors (wires) D in the press-contacting direction are formed on an inner surface of the cover 70.

Next, a method of inserting the press-contacting metal terminals 10 into the connector housing 60 will be described.

As described in detail with reference to FIG. 1, the blade width "B" of the press-contacting blades 31 of the press-contacting metal terminal 10 is larger than the width "b" of the terminal connecting portion 20, and therefore if all of the press-contacting metal terminals 10 are juxtaposed to one another in the same posture in a closely-spaced manner, the press-contacting blades 31 of the adjacent press-contacting metal terminals 10 interfere with each other.

Figure 5:
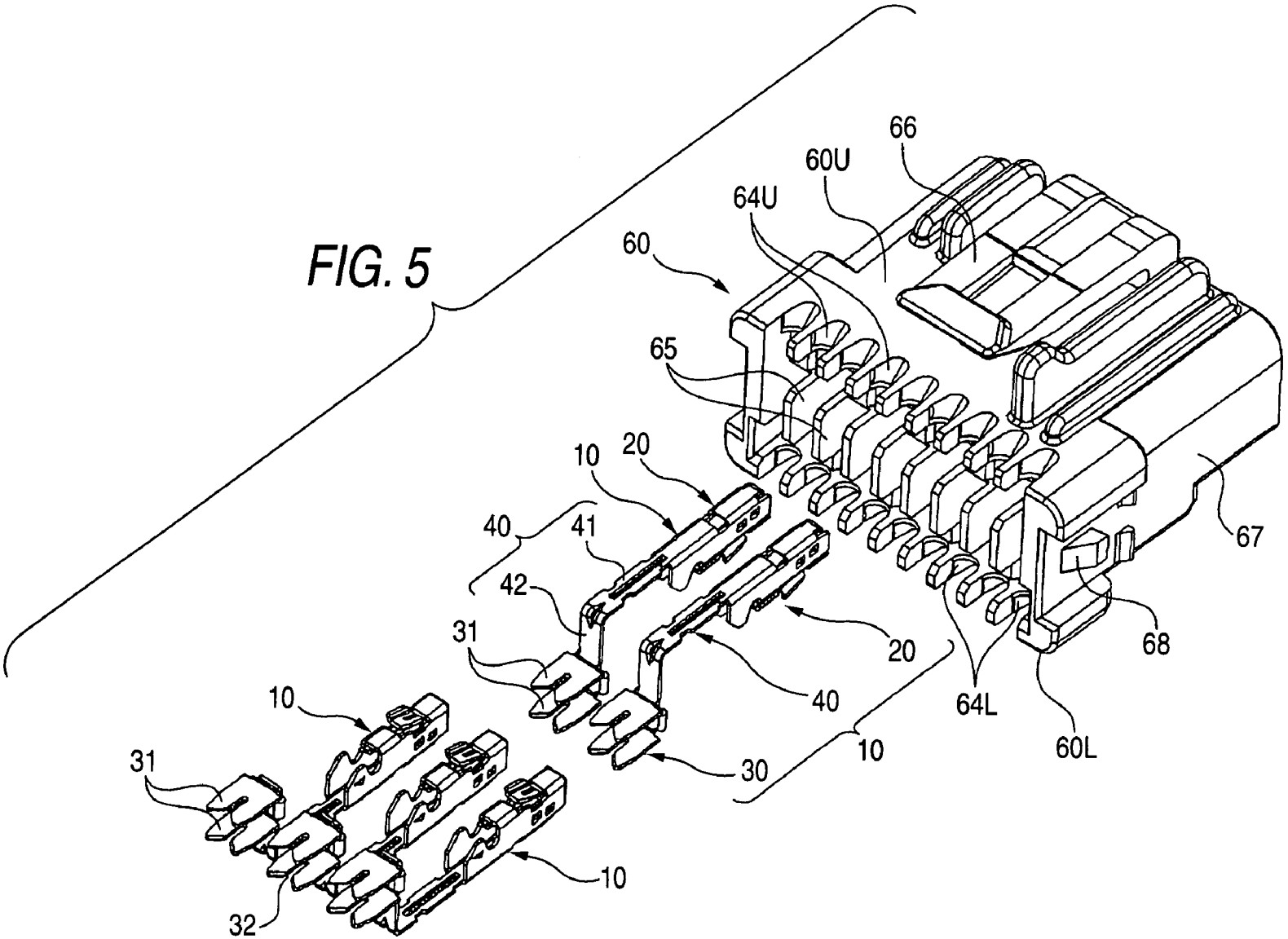
FIG. 5 is a perspective view showing a condition in which the press-contacting metal terminals are to be inserted into a connector housing of FIG. 4.

Therefore, the press-contacting metal terminals 10 to be juxtaposed to one another are alternately inverted (that is, turned upside down about the centerlines CL1 of the corresponding terminal connecting portions 20) as shown in FIG. 5, and then the terminal connecting portions 20 of these press-contacting metal terminals 10 are inserted respectively into the terminal receiving chambers 61 of the connector housing 60. The press-contacting metal terminals 10 are inserted into the connector housing 60 in such a manner that their terminal connecting portions 20 are inserted respectively into the terminal receiving chambers 61 from the rear side (left side in FIG. 5) of the connector housing 60.

Figure 6:
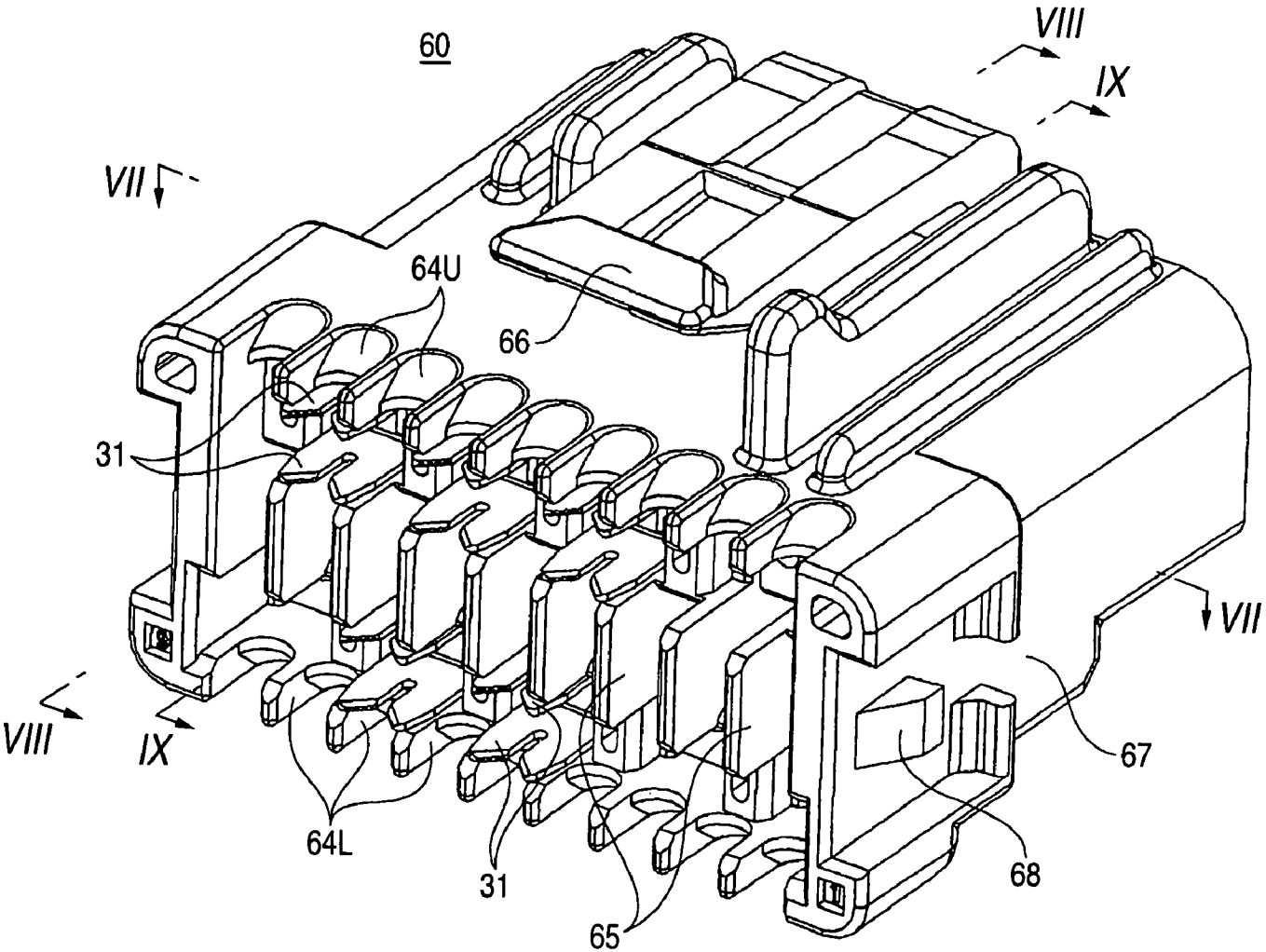
FIG. 6 is a perspective view showing a condition in which the press-contacting metal terminals are received in the connector housing of FIG. 5.
Figure 7:
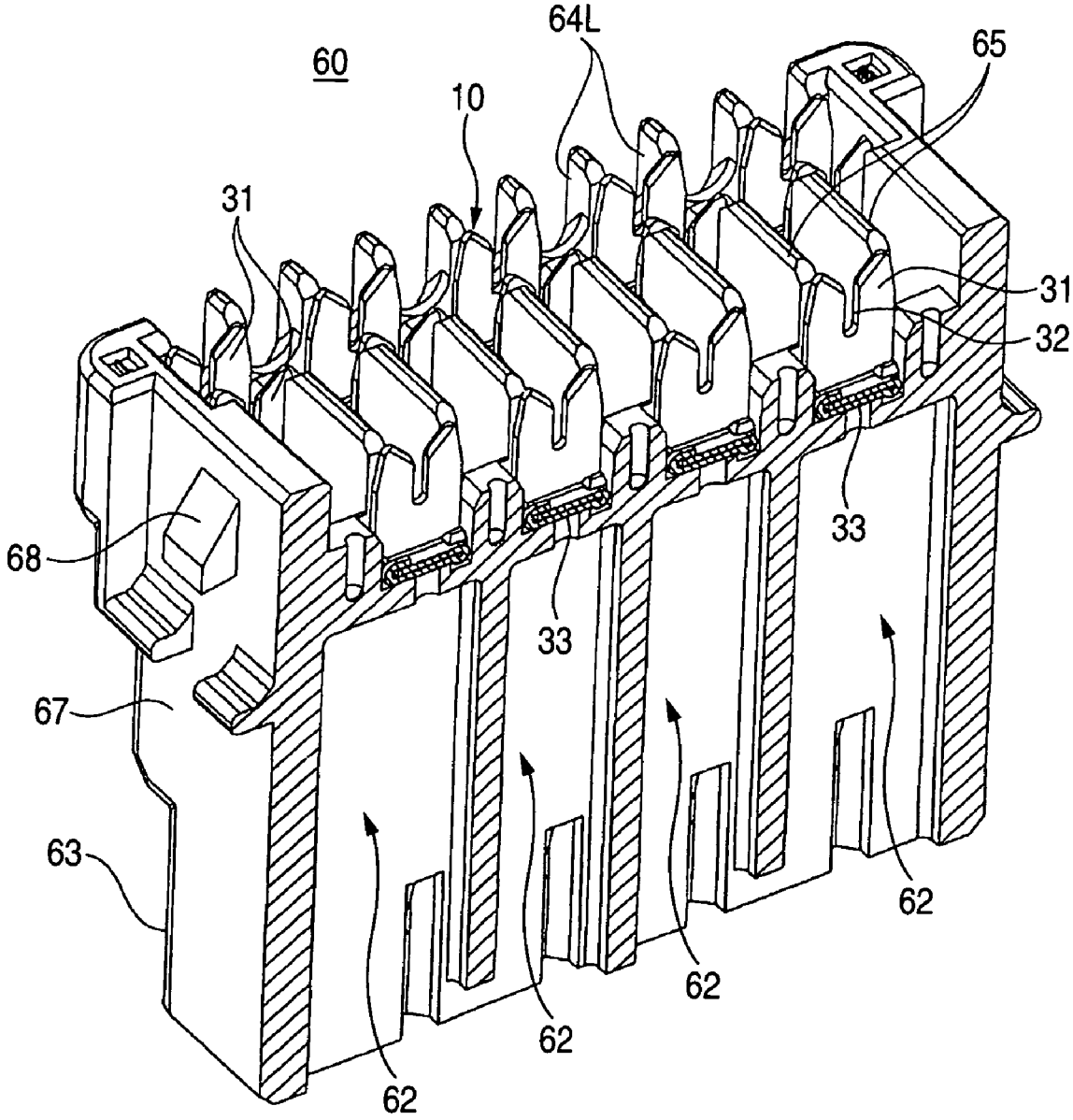
FIG. 7 is a perspective, cross-sectional view taken along the line VII-VII of FIG. 6.
Figure 8:
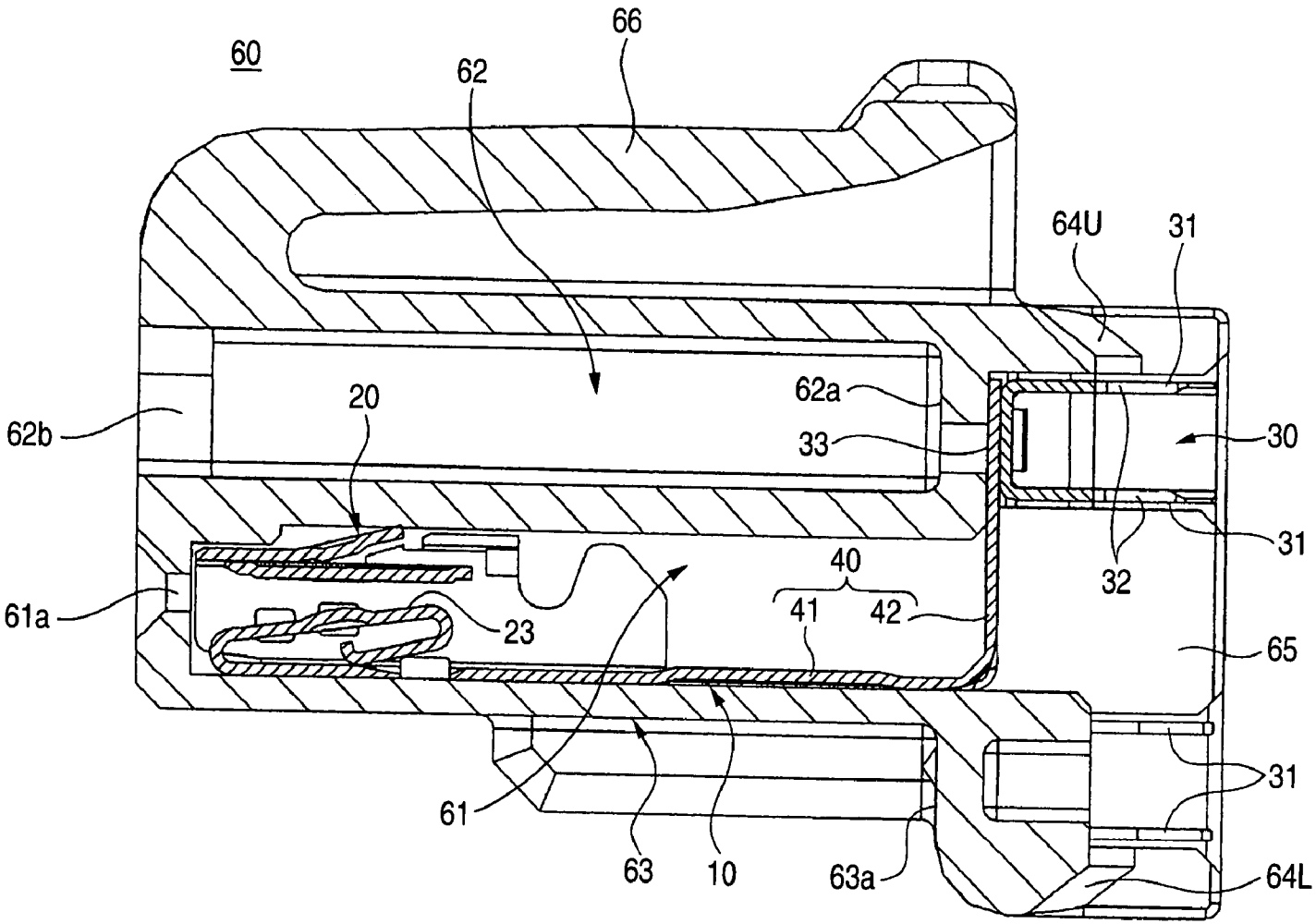
FIG. 8 is a cross-sectional view taken along the line VIII-VIII of FIG. 6.

Namely, although the terminal connecting portions 20 of the plurality of press-contacting metal terminals 10 are received in a juxtaposed manner in the connector housing 60, the wire press-contacting portions 30 (each of which is not aligned with the terminal connecting portion 20) are disposed in a staggered manner, that is, disposed alternately close to the top plate 60 and bottom plate 60L of the connector housing 60 as shown in FIGS. 6 to 8.

Therefore, the wire press-contacting portion 30 is disposed parallel to the terminal fitting direction of the terminal connecting portion 20 as a result of the provision of the interconnecting portion 40 of the press-contacting metal terminal 10, and the wire press-contacting portion 30 is spaced the predetermined distance H from the centerline (axis) CL1 of the terminal connecting portion 20. The wire press-contacting portions 30 are arranged to abut alternately against the inner sides of the upper and lower guide recesses 64U and 64L in the connector housing 60. With this arrangement, the press-contacting blades 31 of any two adjacent press-contacting metal terminals, 10 are spaced a sufficient distance from each other.

Therefore, in the press-contacting connector 50 of this embodiment, the plurality of press-contacting metal terminals 10 are alternately inverted, so that their press-contacting blades 31 are disposed alternately at the upper position and lower position, and with this arrangement the sufficient space is provided between the adjacent press-contacting blades 31. Therefore, even in the case where the terminal connecting portions 20 of the press-contacting metal terminals 10 are received in the connector housing in juxtaposed, closely-spaced relation to one another, the adjacent press-contacting blades 31 are prevented from interfering with each other. Therefore, the compact design of the press-contacting metal terminal 10, as well as the compact design of the press-contacting connector 50, can be achieved.

Next, the operation for press-contacting the wires D with the press-contacting blades 31 in the press-contacting connector 50 will be described.

Figure 9:
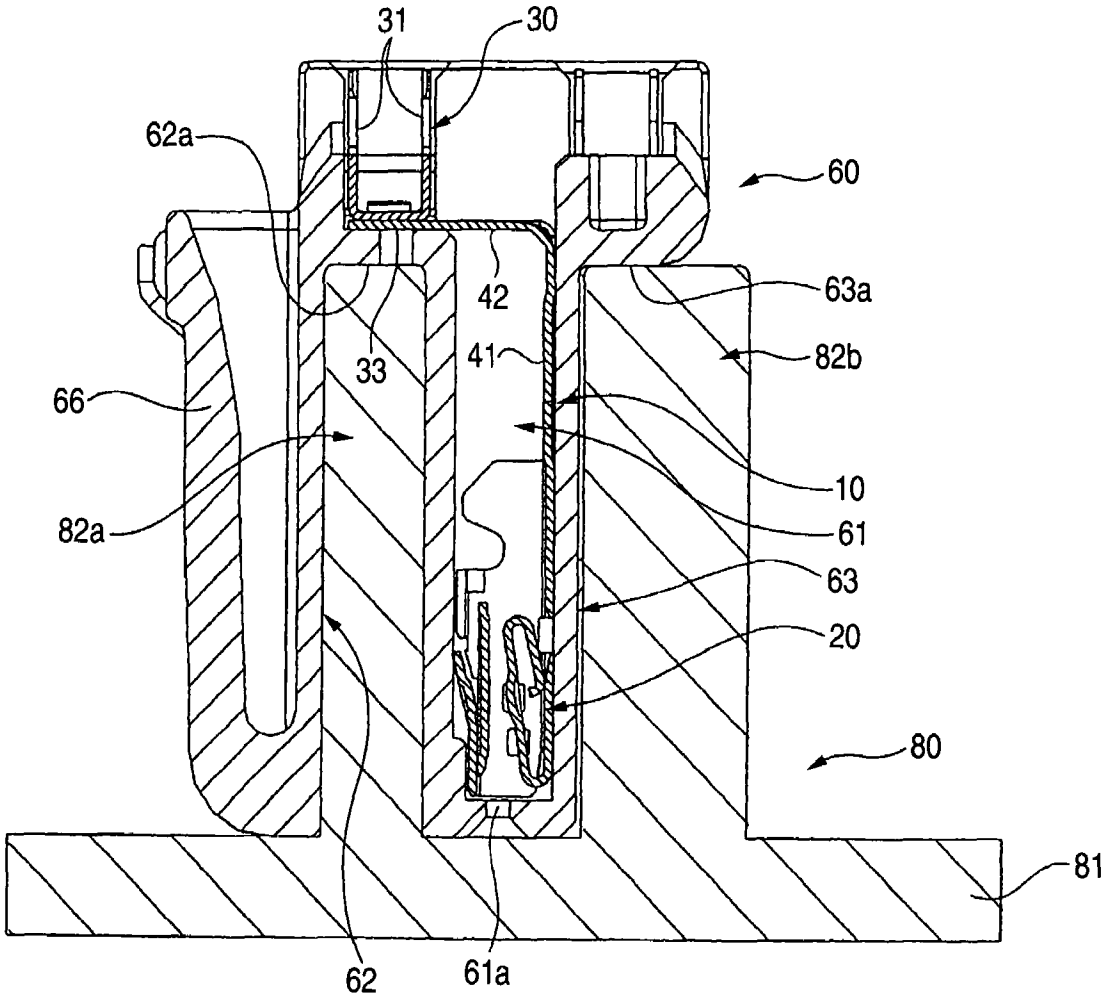
FIG. 9 is a cross-sectional view taken along the line IX-IX of FIG. 6.

First, the support jig 80 is inserted along the support portion-inserting portions 62 and the support portion-sliding surface 63 of the connector housing 60 as shown in FIG. 9.

The support jig 80 includes a plate-like base portion 81, the four juxtaposed narrow support portions 82*a* extending perpendicularly from the base portion 81 so as to be inserted into the support portion-inserting portions 62, and the wide support portion 82*b* extending perpendicularly from the base portion 81 in parallel relation to the support portions 82*a* so as to slide along the support portion-sliding surface 63.

A distal end of each inserted support portion 82*a* abuts against a bottom wall surface 62*a* of the corresponding support portion-inserting portion 62, and a distal end of the support portion 82*b* abuts against an abutment surface 63*a* formed at a rear end of the support portion-sliding surface 63.

The bottom wall surfaces 62*a* and the abutment surface 63*a*, formed at the connector housing 60, are arranged to correspond to the wire press-contacting portions 30 of the press-contacting metal terminals 10 received in the connector housing 60, and the distal ends of the support portions 82*a* are opposed respectively to the press-contact receiving faces 33 of the corresponding wire press-contacting portions 30 through the inner wall of the connector housing, while the distal end of the support portion 82*b* is opposed to the press-contact receiving faces 33 of the corresponding wire press-contacting portions 30 through the inner wall of the connector housing.

By the use of a press-contacting machine (not shown), each wire D is press-fitted into the press-contacting blades 31 of the corresponding press-contacting metal terminal 10 in the connector housing 60 set on the support jig 80, and by doing so, the wire D is press-contacted with the press-contacting blades 31.

At this time, the press-contacting force, supported by the inner wall of the connector housing through the press-contact receiving face 33 formed at the rear side of the press-contacting blades 33 of each press-contacting metal terminal 10, is received by the corresponding support portion 82*a* (inserted along the support portion-inserting portion 62 of the connector housing 60) or support portion 82*b* (inserted along the support portion-sliding surface 63 of the connector housing 60) of the support jig 80.

Therefore, the press-contacting metal terminal 10 and the connector housing 60 are prevented from being deformed by the press-contacting load, and the wire D can be easily and positively press-contacted with the press-contacting blades 31.

Therefore, variations in height of sheathes of the wires D relative to the press-contacting blades 31 are reduced, so that the reliability of the press-contacting connection is enhanced.

Figure 10:
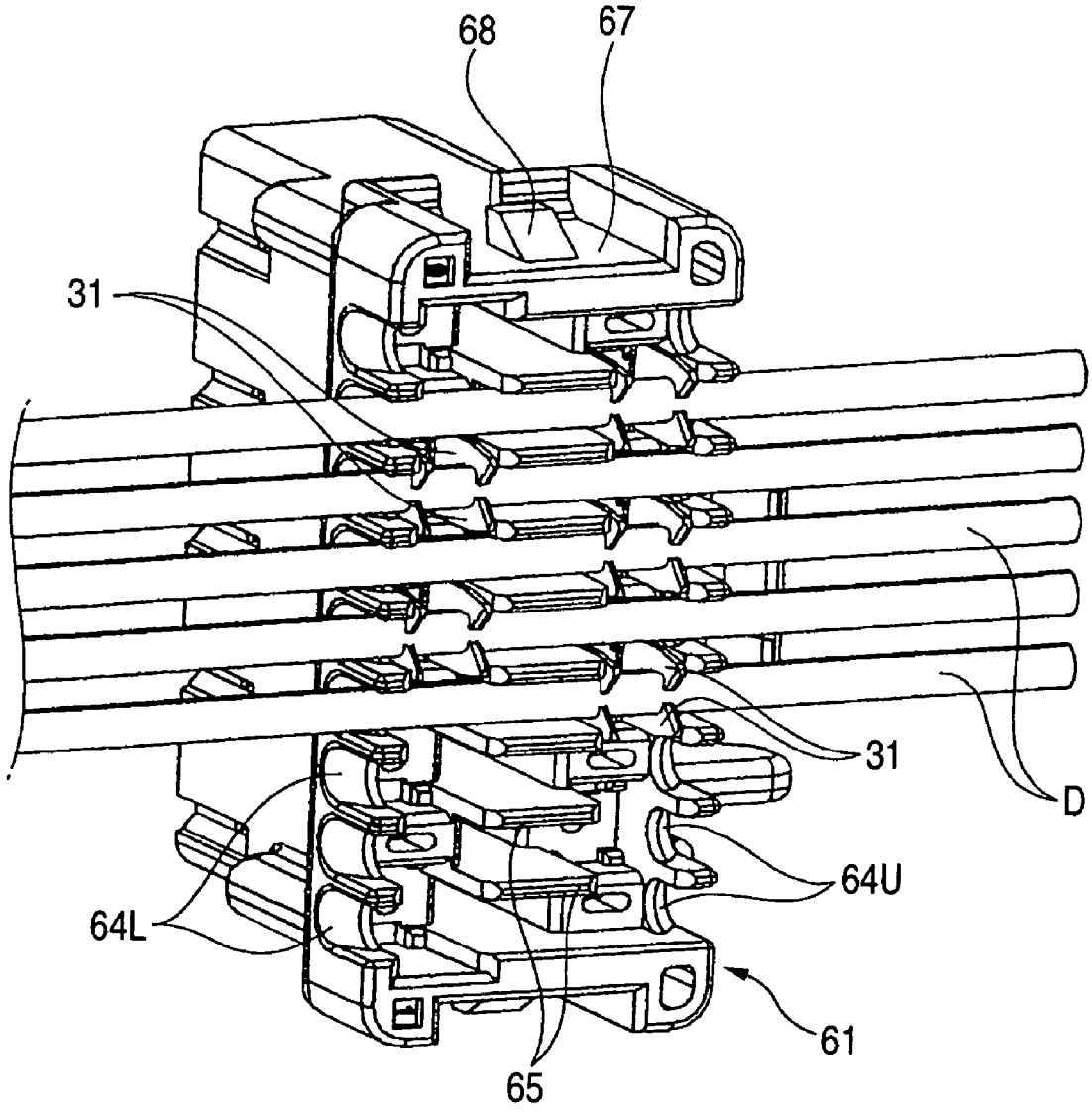
FIG. 10 is a perspective view of the connector housing with which the wires are press-contacted.

As shown in FIG. 10, the press-contacting blades 31 of the juxtaposed press-contacting metal terminals 10 are alternately inverted, and therefore the press-contacting blades 31 of the juxtaposed terminals 10, press-contacted with the respective wires D, are disposed alternately at the upper position and the lower position, and the plurality of juxtaposed wires D can be press-contacted at a pitch smaller than the blade width "B" of the press-contacting blades 31.

Figure 11:
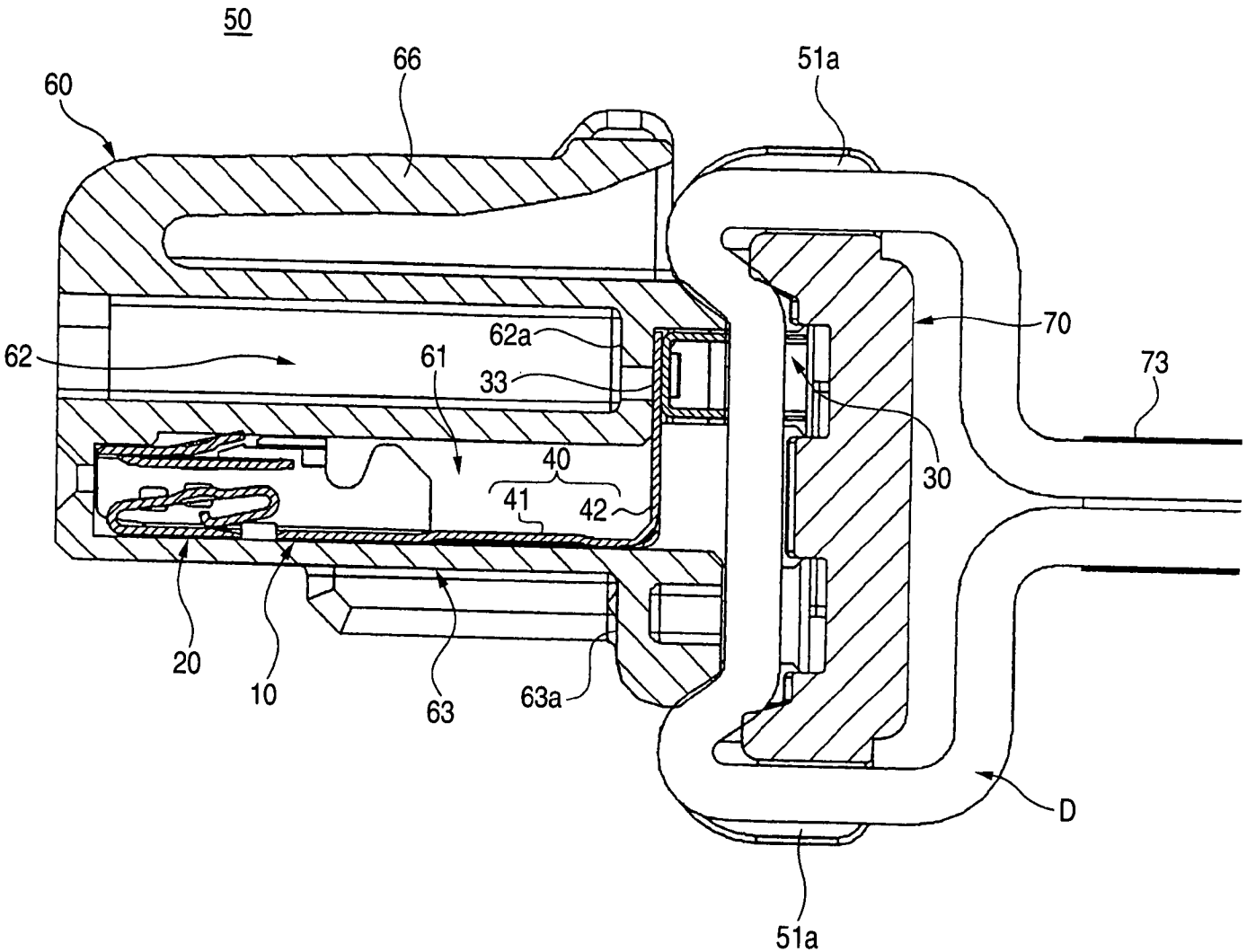
FIG. 11 is a longitudinal cross-sectional view of the press-contacting connector with which the wires are press-contacted.
Figure 12:
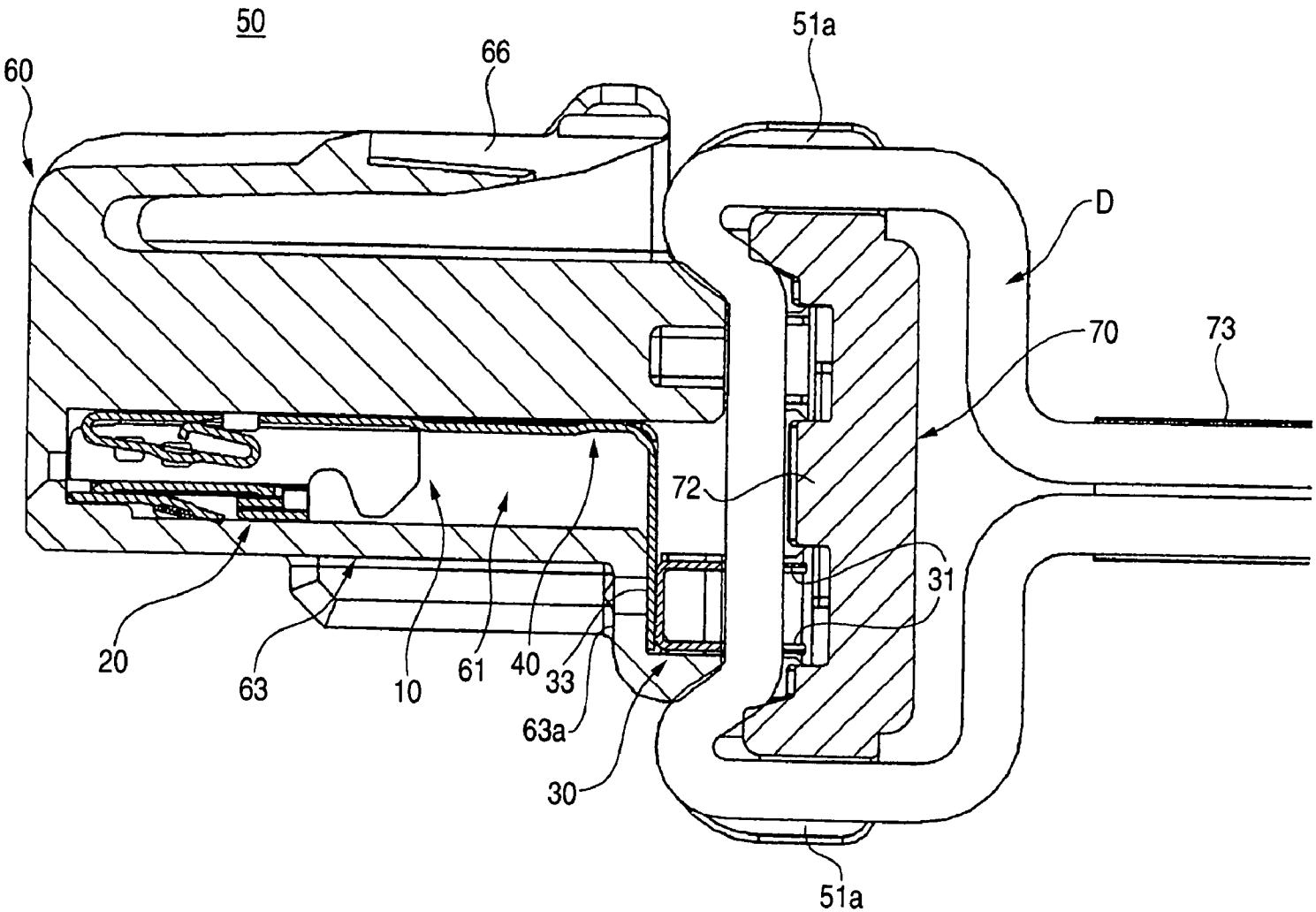
FIG. 12 is a longitudinal cross-sectional view of the press-contacting connector with which the wires are press-contacted.

After the wires D are press-contacted with the press-contacting metal terminals, respectively, the cover 70 is fitted on the rear end of the connector housing 60 as shown in FIGS. 11 and 12, and the lock arms 71 are locked respectively to the retaining projections 68 of the connector housing 60, so that the wires D are held in a bent condition between the cover 70 and the connector housing 60.

Then, opposite lead-out portions of each wire D, extending respectively in the upward and downward directions, are guided reawardly by the guide ribs 51*a* of the cover 70, respectively, and are bundled together by a binding member 73 such as an insulating tape. FIG. 11 shows the wire D press-contacted with the press-contacting blades 31 disposed at the upper portion of the connector, and FIG. 12 shows the wire D press-contacted with the press-contacting blades 31 disposed at the lower portion of the connector.

Therefore, when each wire D is press-contacted with the corresponding press-contacting blades 31 in the press-contacting connector 50, an excessive press-contacting force will not act on the connector housing 60 and the terminal connecting portion 20 of the press-contacting metal terminal 10, and the press-contacting metal terminals 10 and the connector housing 60 are prevented from being deformed, and besides each wire D can be easily and positively press-contacted with the corresponding press-contacting blades 31.

The press-contacting metal terminal and the press-contacting connector of the invention are not limited to the above embodiment, and can take various forms on the basis of the subject matter of the invention.

For example, in the above embodiment, the plurality of sheathed wires are used as the wires to be press-contacted with the terminals, there can be used a plurality of separate insulated conductors obtained by suitably dividing a flat wire comprising the plurality of juxtaposed conductors covered with an insulating material.

Next, a second embodiment of the present invention will now be described in detail with reference to the drawings.

Figure 13:
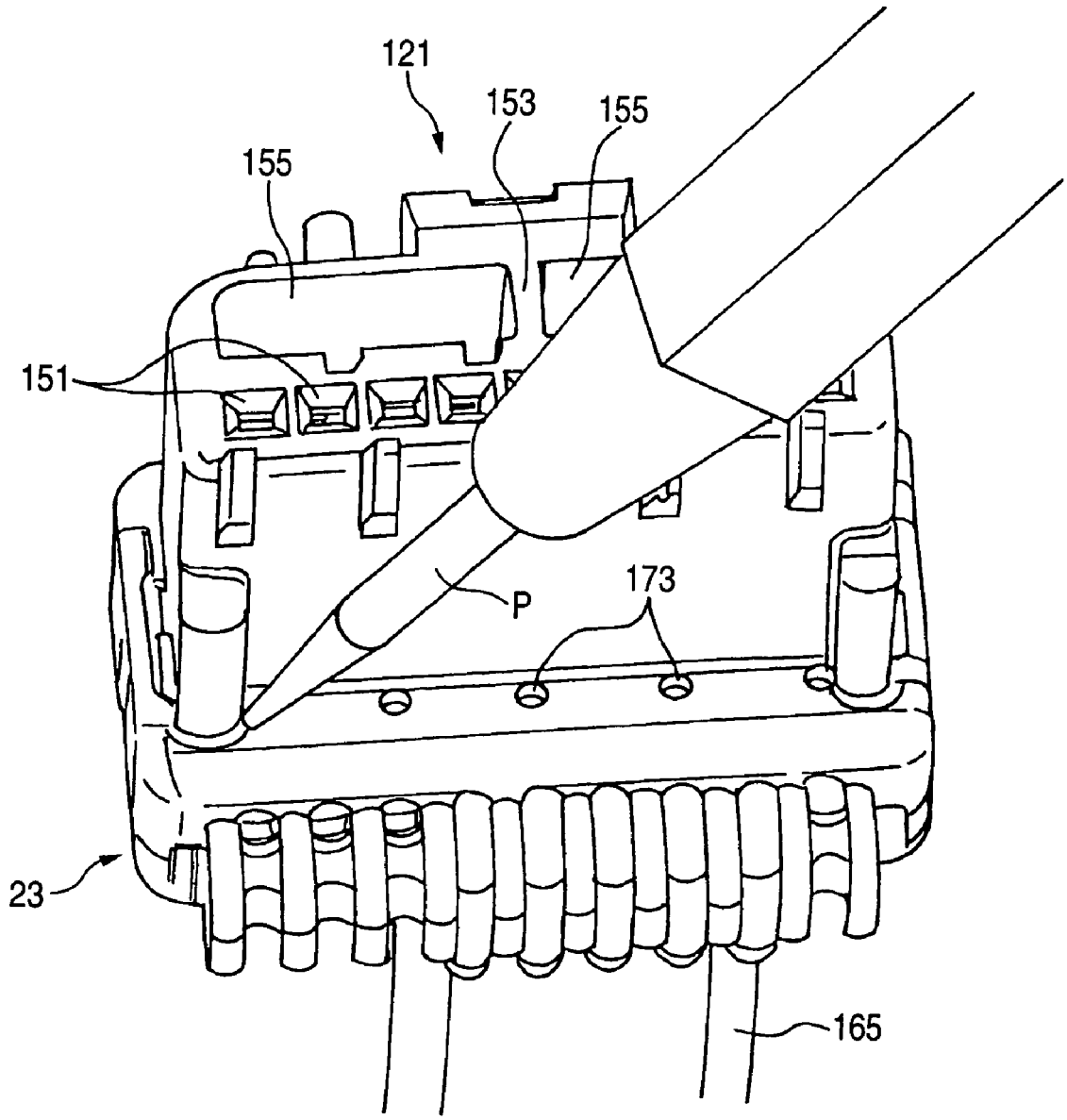
FIG. 13 is a perspective view of a connector according to a second embodiment of the invention as seen from a lower front side thereof, showing a condition of an electrical connection check.
Figure 14:
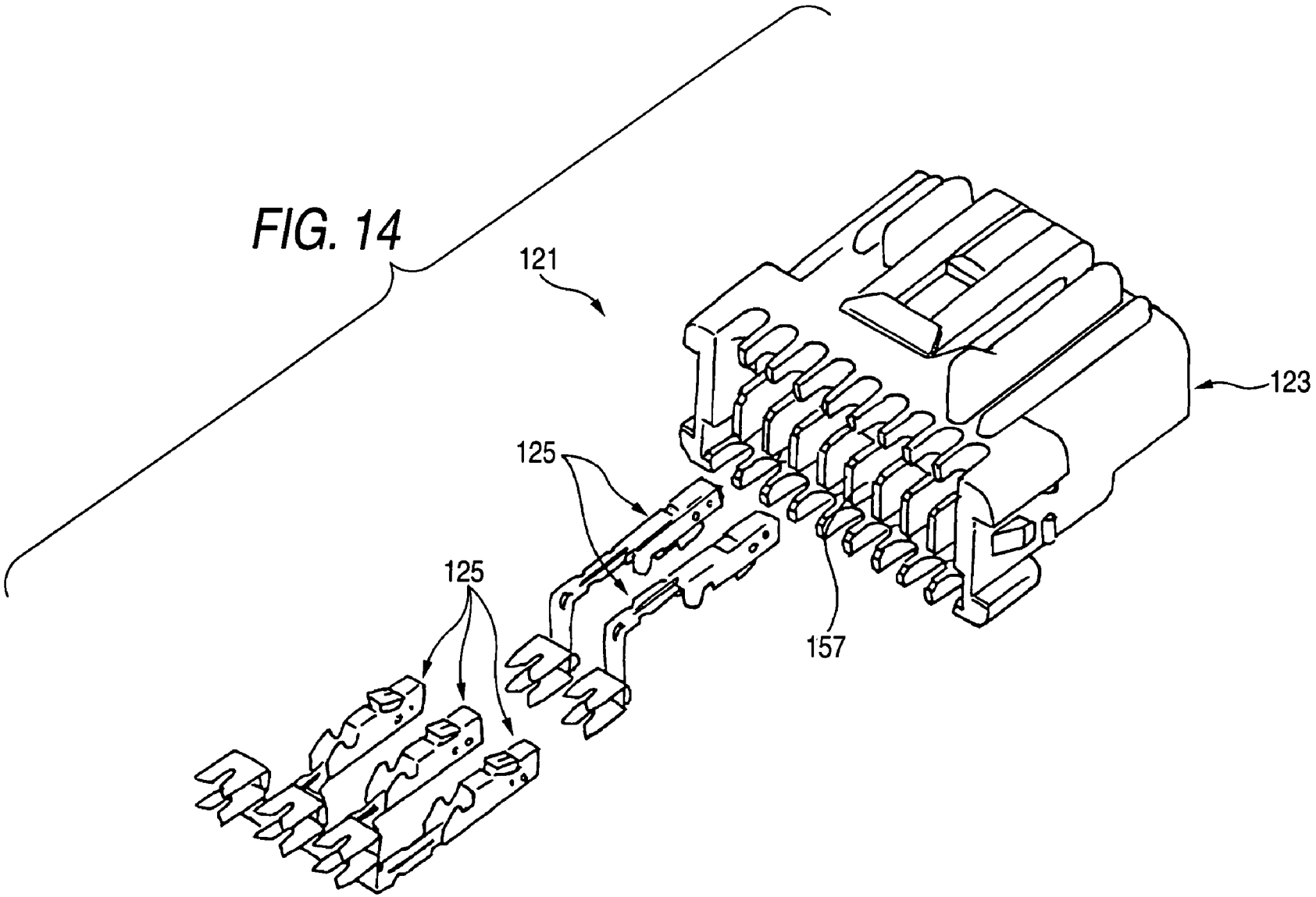
FIG. 14 is an exploded, perspective view of the connector of FIG. 13.

As shown in FIGS. 13 and 14, the connector 121 of this embodiment includes a housing 123 molded of a synthetic resin, the plurality of terminals 125 received in the housing 123, and a wire retaining member (retainer) which will be described later.

Figure 15:
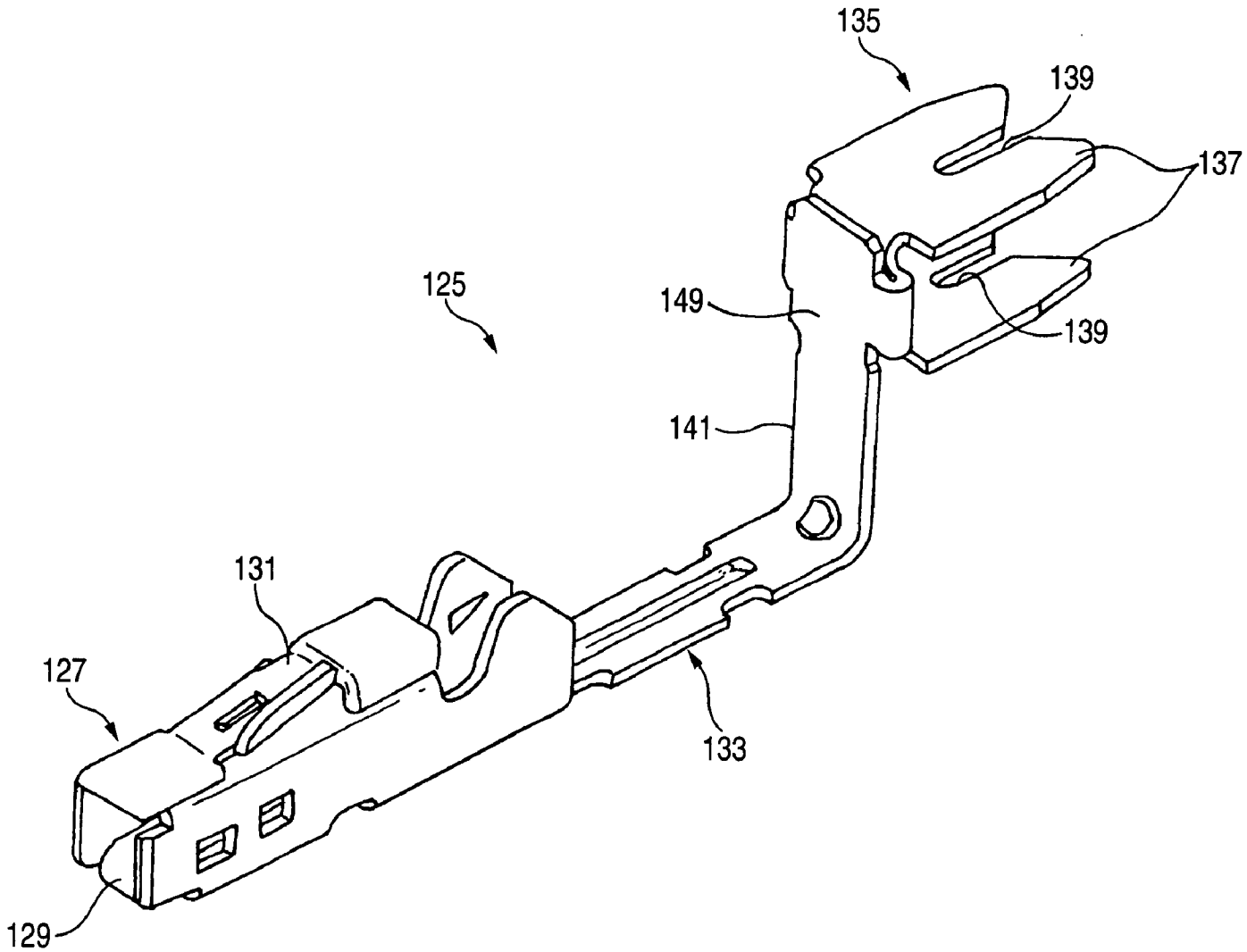
FIG. 15 is a perspective view of a terminal shown in FIG. 14.

As shown in FIG. 15, the terminal 125 is formed by bending an electrically-conductive sheet material, and this terminal 125 has a box-like electrical contact portion 127 formed at its front portion. A resilient contact piece portion 129 for contact with a mating male terminal (not shown) is formed by bending, and is received within the electrical contact portion 127.

A retaining piece portion 131 is formed by bending on an upper outer surface of the electrical contact portion 127, and extends toward the rear end of the terminal in a slanting manner. When the terminal 125 is inserted into the housing 123, the retaining piece portion 131 is brought into retaining engagement with a retaining portion (not shown) within the housing 123 to prevent the withdrawal of the terminal 125.

An extension portion 133 is formed at a rear portion of the terminal 125, and extends rearwardly from a bottom plate portion of the box-like body, and a press-contacting portion 135 is formed at a rear end of the extension portion 133. The press-contacting portion 135 includes a pair of parallel press-contacting blades 137, and each of the press-contacting blades 137 has a groove 139 in the form of a slit extending from a rear edge thereof to a central portion thereof.

When a sheathed wire is press-fitted into the press-contacting blades 137, a sheath of the sheathed wire is cut by blade portions (defined respectively by opposed side edges of each groove 139), so that the press-contacting portion 135 is electrically connected to a conductor provided within the sheathed wire.

The extension portion 133 has an upstanding piece portion (bent portion) 141 formed between the electrical contact portion 127 and the press-contacting portion 135, and this bent portion 141 projects in an upstanding manner in a direction intersecting (that is, "perpendicular to" in this embodiment) a direction of insertion of the terminal 125. The press-contacting portion 135 is provided at an upper end of this bent portion 141, and extends rearwardly.

Therefore, the wire, connected to the press-contacting portion 135, is disposed perpendicular to the direction of insertion of the terminal 125.

Figure 16:
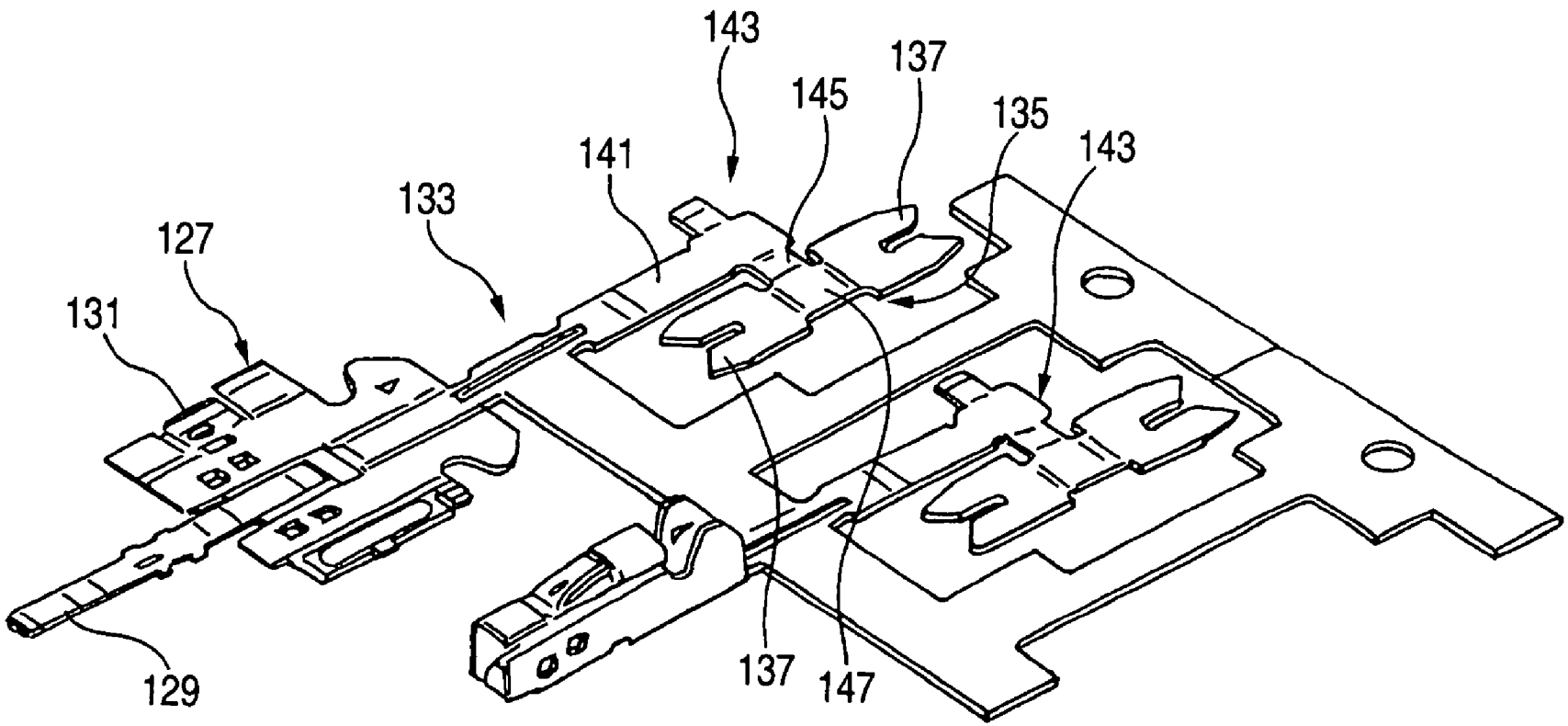
FIG. 16 is a developed view showing the process of forming the terminals of FIG. 15 from a metal sheet.

As shown in FIG. 16, the terminal 125 is formed by bending (sheet metal working) of one developed member 143 blanked by pressing or the like from a metal sheet. Reference numerals in FIG. 16 denote the various portions of the terminal 125 in the form of the developed member 143.

In this developed member 143, the press-contacting portion 135 is connected to the extension portion 133 by a connecting portion 145 extending laterally from the rear end portion of the extension portion 133. The pair of press-contacting blades 137 are formed respectively at front and rear edges of a base plate 147 (of the press-contacting portion) extending from the connecting portion 145.

Figure 17:
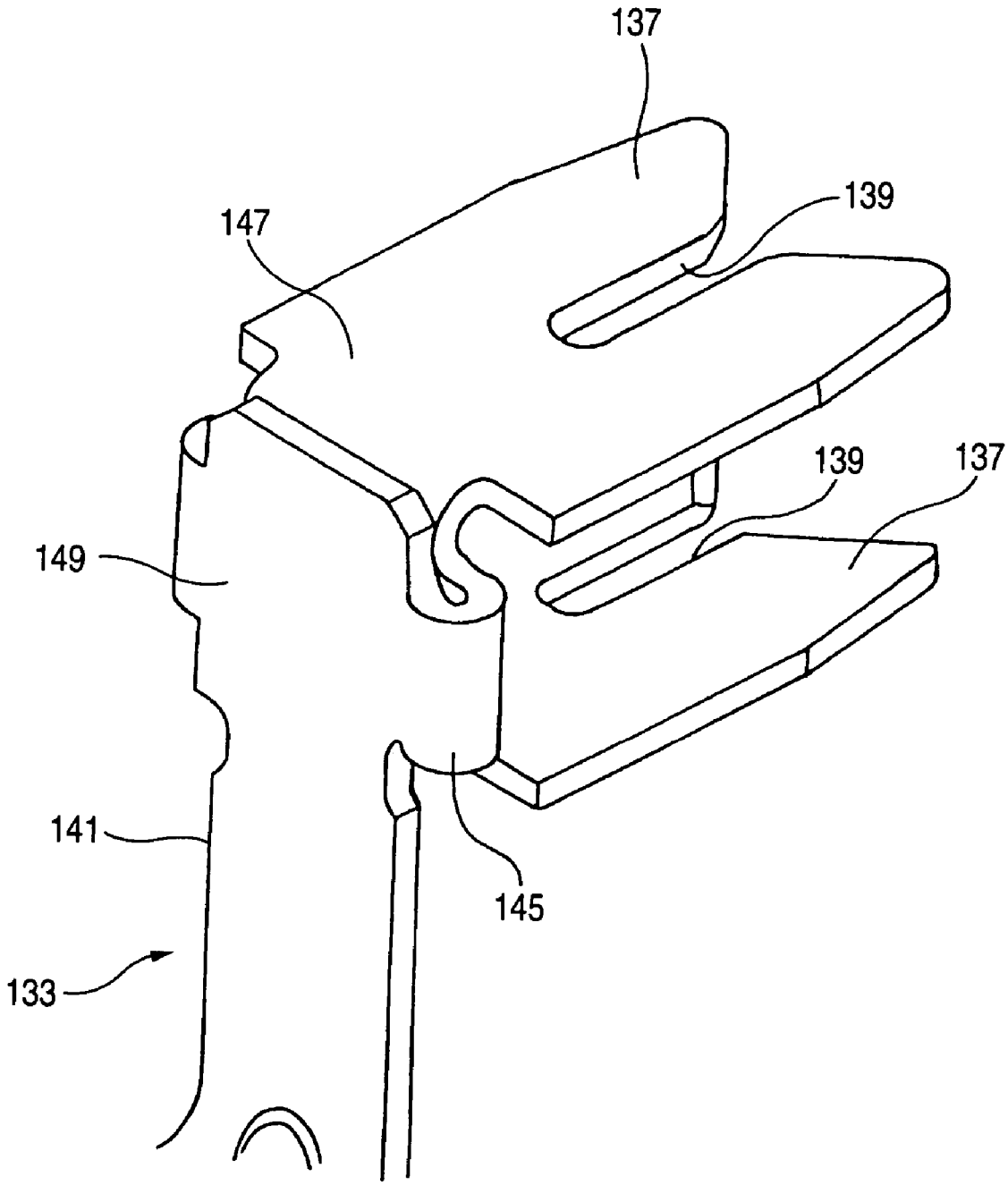
FIG. 17 is an enlarged view of an important portion of the terminal of FIG. 15.

Therefore, the press-contacting portion 135 is formed by sheet metal working as follows. First, the connecting portion 145 is bent rearwardly relative to the extension portion 133, and then the pair of upper and lower press-contacting blades 137 are perpendicularly bent rearwardly relative to the base plate 147 (of the press-contacting portion) disposed parallel to the extension portion 133, as shown in FIG. 17.

That surface 149 of the extension portion 133, facing away from this press-contacting portion 135, serves as a tester probe-contacting surface as described later. Thus, a probe is adapted to be brought into contact with the surface 149 of the extension portion 133, and therefore the probe will not be brought into direct contact with the press-contacting portion 135.

The extension portion 133 and the base plate 147 of the press-contacting portion 135 jointly provide a double-wall structure in which these two plate portions are disposed in contiguous relation to each other, and therefore a higher strength is obtained as compared with the case where this portion is formed by a single plate portion.

Figure 18:
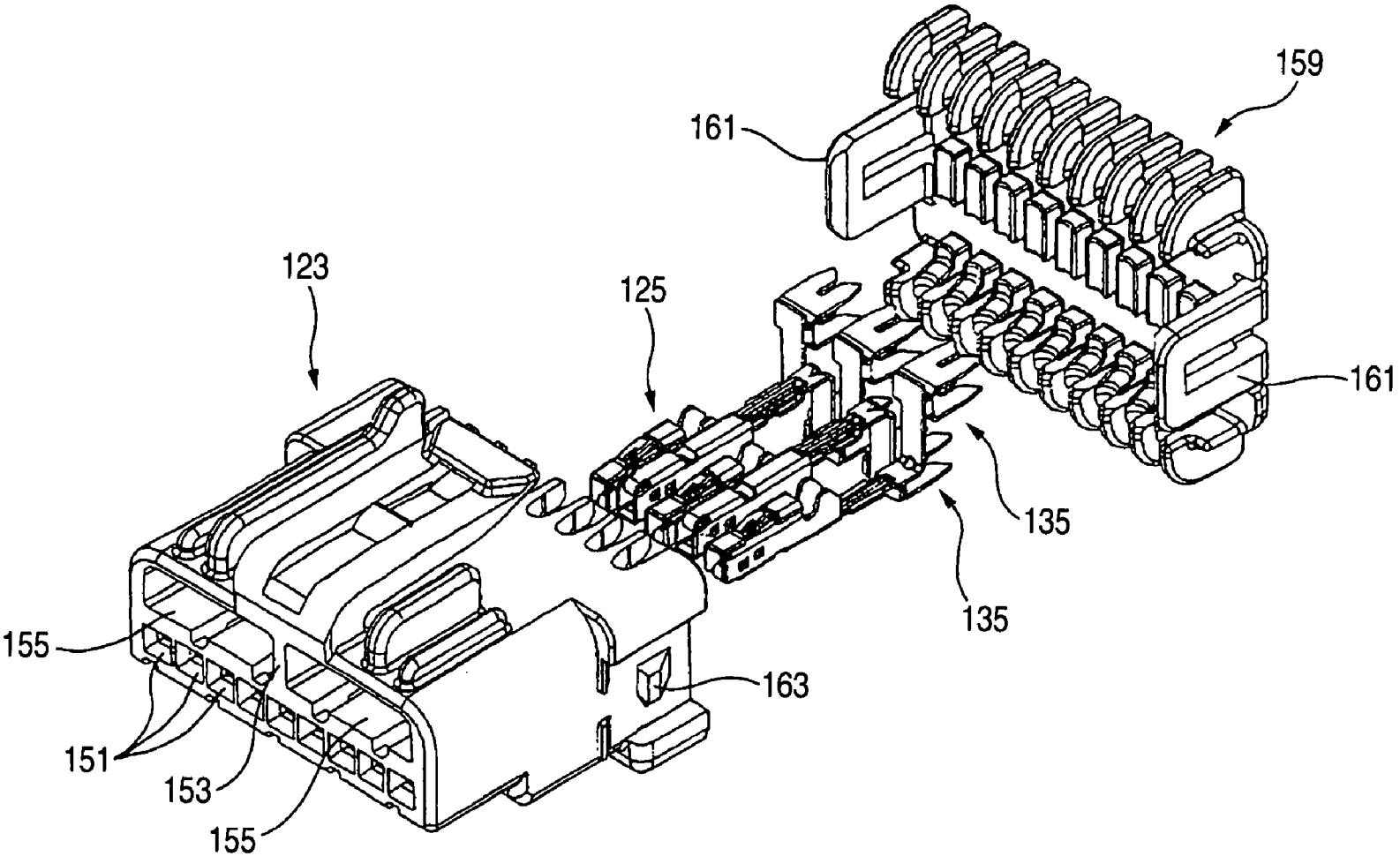
FIG. 18 is an exploded, perspective view of the connector of FIG. 13 as seen from an upper front side thereof.

As shown in FIG. 18, the housing 123 has a hollow portion which is divided into two (upper and lower) sections. A plurality of juxtaposed terminal receiving chambers 151 for respectively receiving the terminals 125 are formed in the lower hollow section, and are arranged in a row.

The upper hollow section is divided by a partition wall 153 into insertion ports 155 each corresponding to a predetermined number of terminal receiving chambers 151.

As shown in FIG. 14, each of the terminal receiving chambers 151 is open to the rear side of the housing 123, and the terminal 125 is inserted into the terminal receiving chamber through this rear opening 157. In the housing 123 of this embodiment, the terminals 125 are mounted respectively in the terminal receiving chambers 151 in such a manner that the juxtaposed terminals 125 are alternately inverted (that is, turned upside down).

Therefore, the press-contacting portions 135, formed respectively at the rear ends of the juxtaposed terminals 125, are arranged in the rear portion of the housing 123 in such a manner that the press-contacting portions 135 of any two adjacent terminals 125 are disposed in reversed relation to each other as shown in FIG. 18.

The wires are press-fitted respectively into the press-contacting portions 135 located in the rear portion of the housing 123. After the press-fitting of the wires, the retainer 159 is attached to the rear end of the housing 123, the retainer 159 having such a configuration that it can press those portions of the wires held respectively in the press-contacting portions 135.

Figure 19:
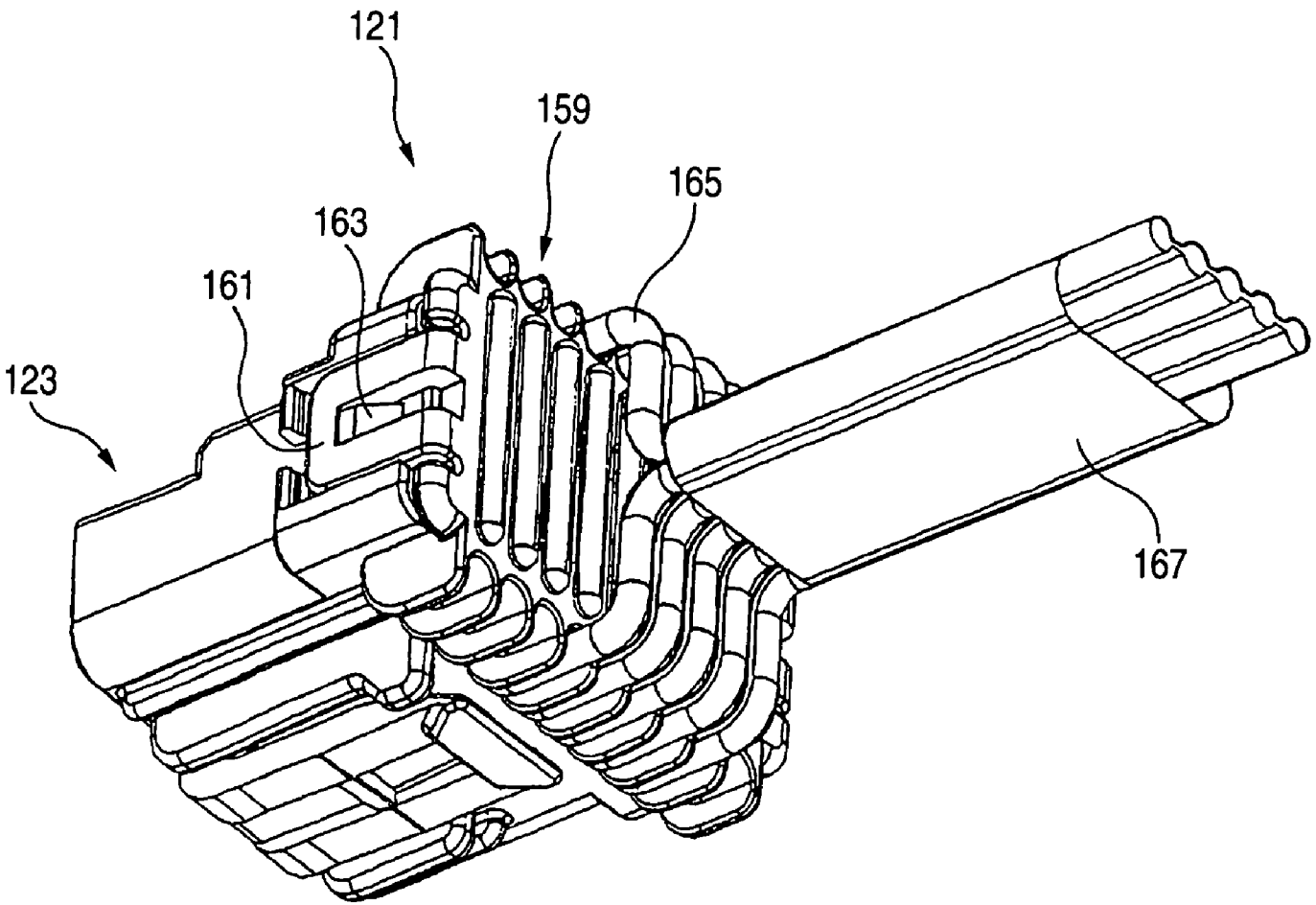
FIG. 19 is a perspective view of the connector, having wires connected thereto, as seen from a rear side thereof.

The retainer 159 has retaining frames 161 of a generally rectangular shape formed respectively at opposite ends thereof, and these retaining frames 161 are retainingly engaged respectively with projections 163 formed respectively on opposite side surfaces of the housing 123, thereby fixing the retainer 159 to the rear end of the housing 123 as shown in FIG. 19.

The retainer 159 is thus fixed to the rear end of the housing 123, thereby preventing the wires 165 (press-contacted respectively with the press-contacting portions 135) from moving relative to the respective grooves 139 in the withdrawing direction so as to maintain the good electrically-connected condition.

The wires 165, retained by the retainer 159, extend rearwardly along the upper and lower surfaces of the retainer 159, and are bundled together, for example, into a flat configuration by a binding band 167 or the like.

Figure 20:
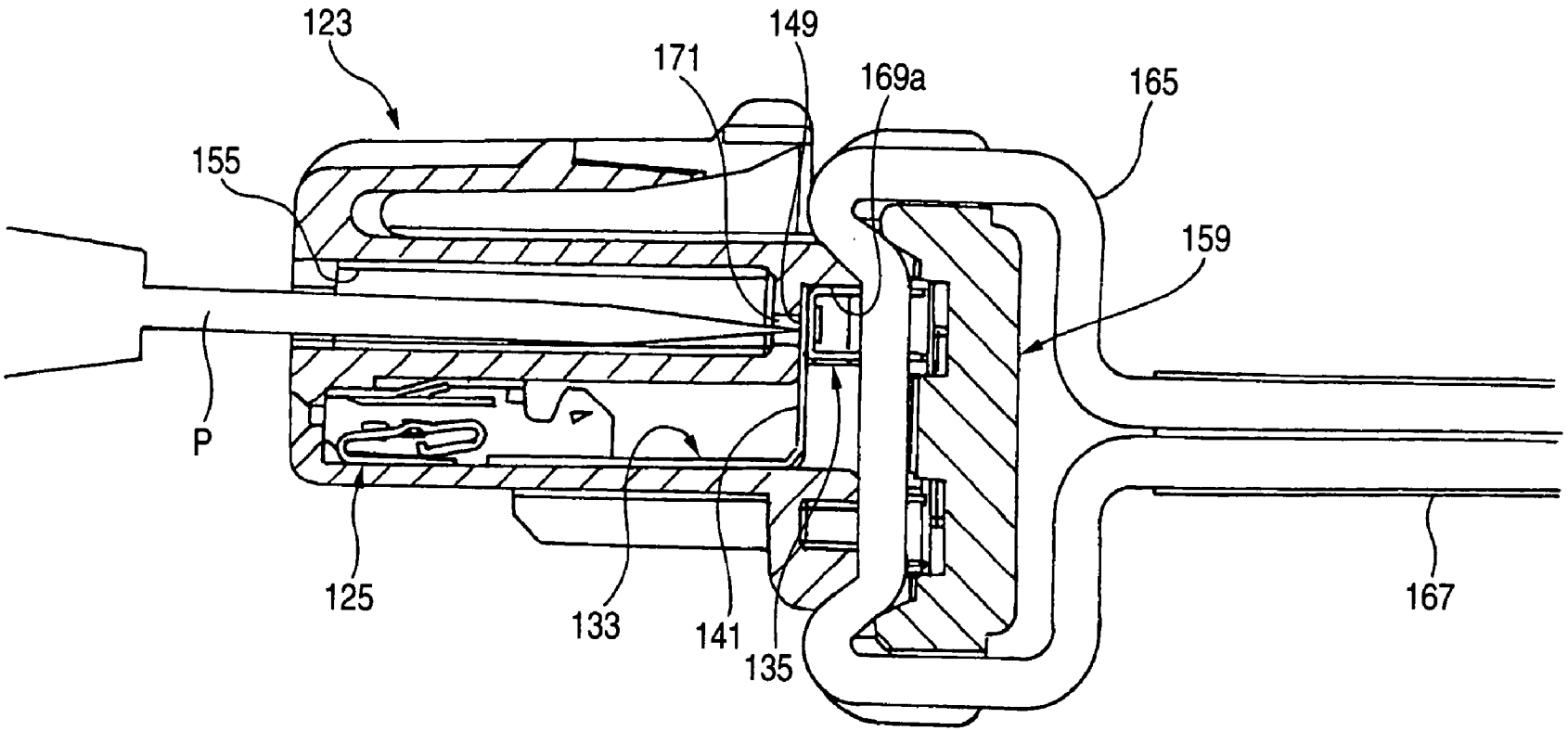
FIG. 20 is a longitudinal cross-sectional view showing an electrical connection check for the terminal received in a lower receiving chamber.
Figure 21:
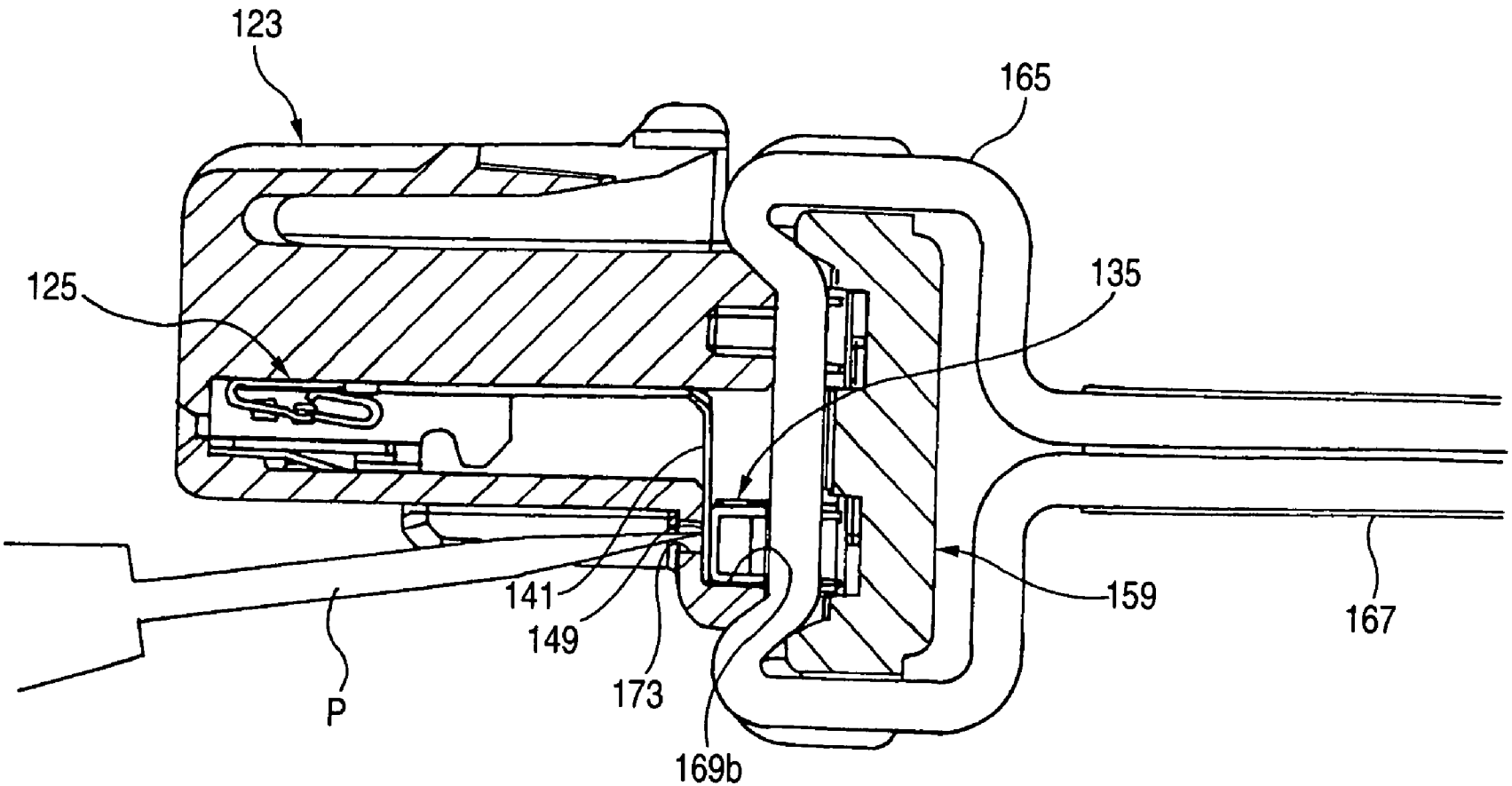
FIG. 21 is a longitudinal cross-sectional view showing an electrical connection check for the terminal received in an upper receiving chamber.

Upper recesses 169*a* for respectively holding the corresponding press-contacting portions 135, as well as lower recesses 169*b* for respectively holding the corresponding press-contacting portions 135, are formed in the rear end portion of the housing 123 as shown in FIGS. 20 and 21, and the plurality of upper recesses 169*a* and the plurality of lower recesses 169*b* are arranged in two (upper and lower) rows in such a manner that these recesses 169*a* and 169*b* correspond to the terminals 125, respectively. Each of the upper recesses 169*a* communicates with the insertion port 155 through a corresponding through hole 171.

Each of the lower recesses 169*b* is open toward the front side of the housing 123 through a corresponding exposure hole 173 formed in the fitting direction.

With respect to those terminals 125 having the upwardly-directed press-contacting portions 135, respectively, these press-contacting portions 135 are received in the upper recesses 169*a*, respectively, as shown in FIG. 20. With respect to those terminals 125 having the downwardly-directed press-contacting portions 135, respectively, these press-contacting portions 135 are received in the lower recesses 169*b*, respectively, as shown in FIG. 21.

Therefore, with respect to those terminals 125 whose press-contacting portions 135 are received respectively in the upper recesses 169*a*, the surface 149 of the bent portion 141 of each terminal 125 is exposed to the front side of the housing 123 through the corresponding through hole 171 and the insertion port 155. With respect to those terminals 125 whose press-contacting portions 135 are received respectively in the lower recesses 169*b*, the surface 149 of the bent portion 141 of each terminal 125 is exposed to the front side of the housing 123 through the corresponding exposure hole 173.

The through holes 171 and the exposure holes 173 perform a similar function to the function of the detection holes used in the related construction. Namely, when checking the electrical connection of each of those terminals 125 whose press-contacting portions 135 are received respectively in the upper recesses 169*a*, the probe P is inserted into the corresponding through hole 171, disposed just above the terminal 125 to be checked, and is brought into contact with the surface 149 of the bent portion 141 of this terminal as shown in FIG. 20.

When checking the electrical connection of each of those terminals 12.5 whose press-contacting portions 135 are received respectively in the lower recesses 169*b*, the probe P is inserted into the corresponding exposure hole 173, disposed just beneath the terminal 125 to be checked, and is brought into contact with the surface 149 of the bent portion 141 of this terminal as shown in FIG. 21.

In this connector 121, each terminal 125 has the bent portion 141 projecting in an upstanding manner in the direction intersecting the direction of insertion of the terminal 125, and therefore the exposure holes 173 each for exposing the corresponding bent portion 141 can be formed in the direction of removal of a mold.

Therefore, there is no need to use a complicated mold with a slide mold or the like as used in the related construction in which the holes for checking the electrical connection are formed in the direction perpendicular to the direction of removal of the mold, and therefore the structure of the mold can be simplified, so that the cost of the mold can be made low.

And besides, the exposure holes 173 are open in the direction of fitting of the housing into the mating housing (that is, open toward the front side), and therefore the probe P of the tester and the terminal 125 to be checked for its electrical connection can be viewed from the same direction at a position close to them, and the failure to direct the probe to the proper terminal 125 to be checked for its electrical connection hardly occurs, so that the electrical connection check can be effected easily.

The connector of the present invention is not limited to the second embodiment, and suitable modifications and improvements can be made.

Figure 22A:
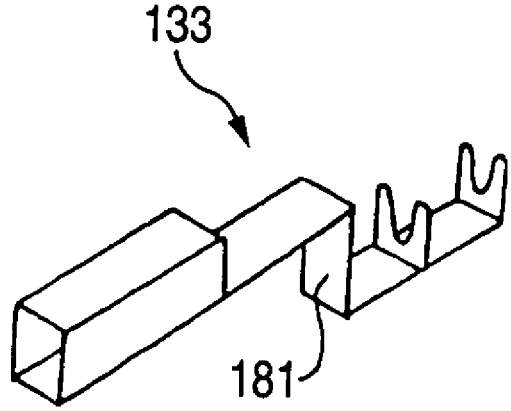
FIGS. 22A to 22C are perspective views showing modified terminals, respectively.

For example, in the second embodiment, the extension portion 133 is bent into an L-shape, thereby forming the bent portion 141. In the connector of the invention, however, any suitable bent portion can be adopted in so far as the bent portion 141, projecting in an upstanding manner in a direction intersecting the direction of insertion of the terminal 125, can be formed at the extension portion 133, and the bent portion is not limited to the L-shape. For example, a bent portion may be an intermediate piece portion 181 formed by bending an extension portion 133 into a crank-shape as shown in FIG. 22A.

Figure 22B:
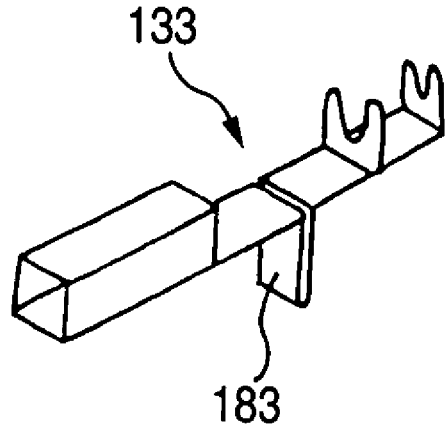

A bent portion may be a hanging piece portion 183 formed by bending a central portion of an extension portion 133 into a generally U-shape as shown in FIG. 22B.

Figure 22C:
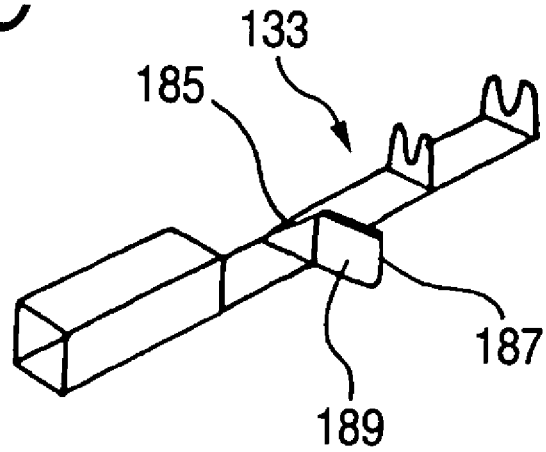
Figure 23:
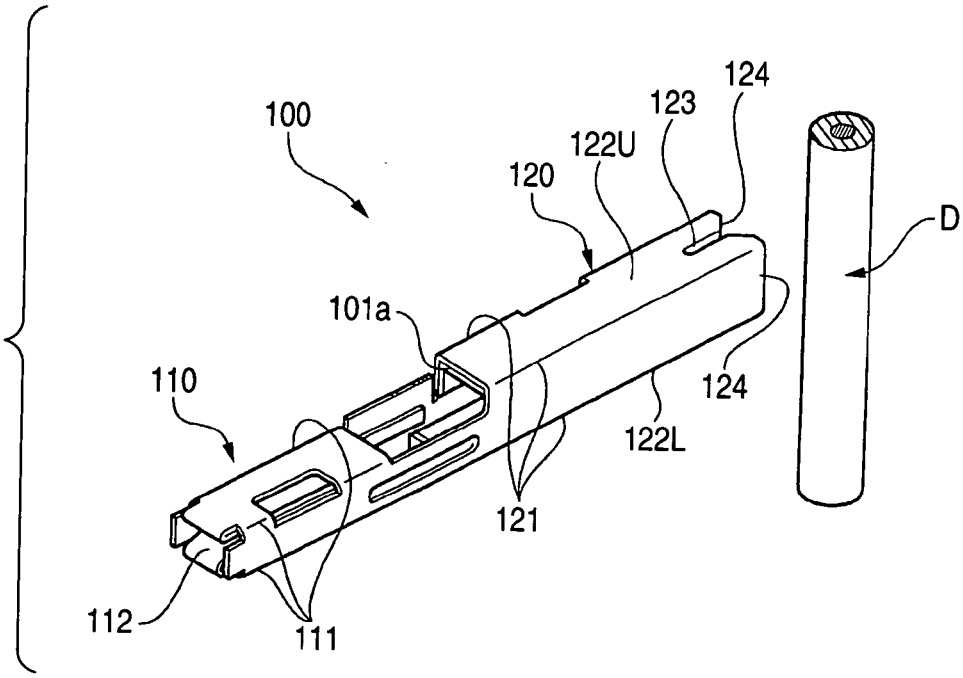
FIG. 23 is a perspective view showing the whole of a related press-contacting metal terminal.
Figure 24:
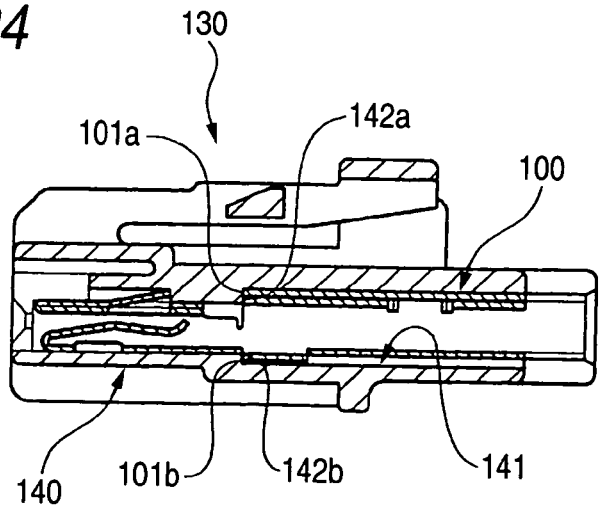
FIG. 24 is a longitudinal cross-sectional view showing a related press-contacting connector.
Figure 25:
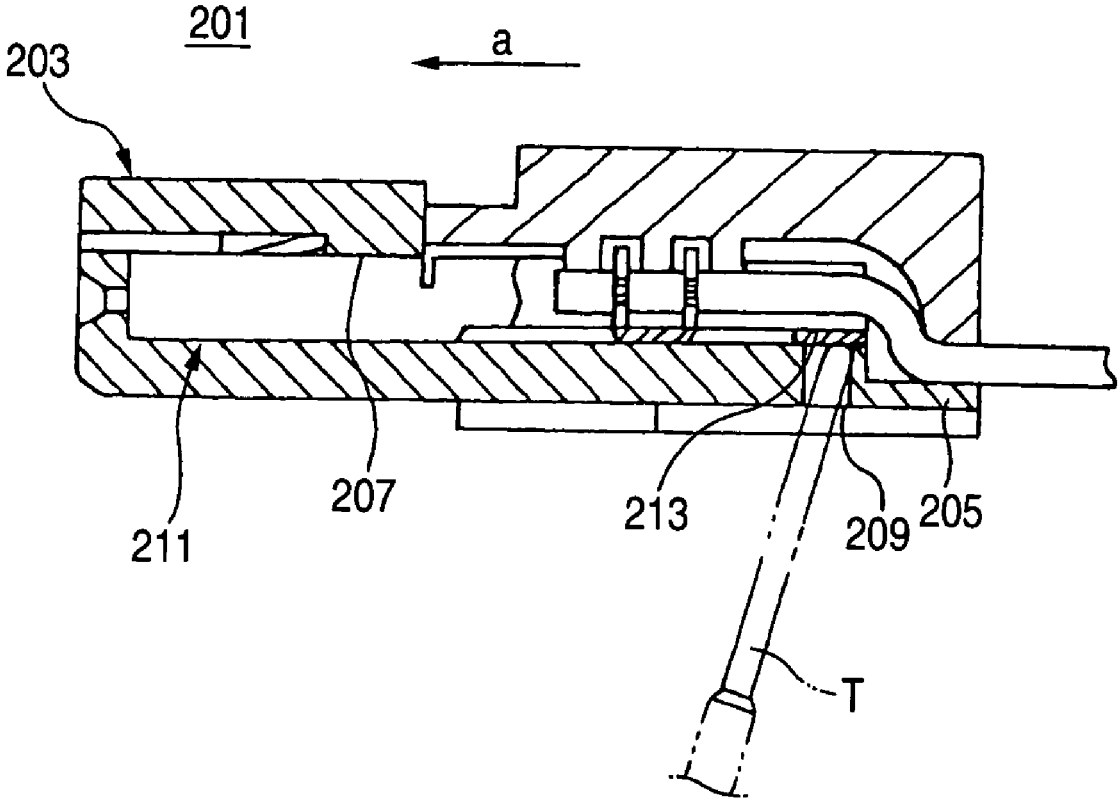
FIG. 25 is a cross-sectional view of a related connector having detection holes.

As shown in FIG. 22C, there may be adopted a structure in which an extension portion 133 is bent upwardly, and then is folded or bent at an angle of 45 degrees along a folding line 185, and further is folded back through an angle of 180 degrees along a vertical folding line 187, and further is folded along a folding line extending in the same direction as that of the folding line 185, thereby forming a bent portion 189 projecting laterally from the extension portion 133.

In the above embodiment, the configuration, dimensions, number, arrangement, etc., of the illustrated insertion ports 155, through holes 171, exposure holes 173, retainer 159 and so on are arbitrary, and are not limited in so far as the present invention can be achieved.

What is claimed is:

1. A connector, comprising:

a plurality of terminals; and a connector housing, receiving the terminals, each of the terminals, including:

a terminal connecting portion, having a tubular shape, and receiving a mating terminal;

a wire press-contacting portion, including a press-contacting blade for press-contacting a wire, and the press-contacting blade having a blade width larger than a width of the terminal connecting portion; and an interconnecting portion, connecting the terminal connection portion and the wire press-contacting portion, wherein a press-contacting direction in which the wire is press-contacted with the wire press-contacting portion is parallel to a terminal fitting direction of the mating terminal into an internal space of the terminal connecting portion;

wherein the interconnecting portion has a horizontal portion and vertical portion with respect to the terminal fitting direction, the vertical portion extends past the terminal connecting portion in a direction perpendicular to the terminal fitting direction, such that the blade is spaced away from the terminal connecting portion by the horizontal portion and the blade is elevated above the terminal connecting portion in the direction perpendicular to the terminal fitting direction;

wherein the terminal connecting portions of the terminals are received in the connector housing in parallel so that the press-contacting blades are arranged in a staggered manner;

wherein the interconnecting portion has a press-contact receiving face which abuts against an inner wall of the connector housing so that a press-contacting force acting on the press-contacting blade is received by the inner wall of the connector housing when the wire is press-contacted with the press-contacting blade; and wherein the connector housing has a support jig-inserting portion into which a support jig for receiving the press-contacting force through the inner wall of the connector housing is inserted.

2. The connector as set forth in claim 1, wherein the press-contact receiving face is formed at a rear side of the press-contacting blade.

3. A connector, comprising:

a plurality of terminals; and a connector housing, receiving the terminals, each of the terminals, including:

a terminal connecting portion, having a tubular shape, and receiving a mating terminal;

a wire press-contacting portion, including a press-contacting blade for press-contacting a wire, and the press-contacting blade having a blade width larger than a width of the terminal connecting portion; and an interconnecting portion, connecting the terminal connection portion and the wire press-contacting portion, wherein a press-contacting direction in which the wire is press-contacted with the wire press-contacting portion is parallel to a terminal fitting direction of the terminal connecting portion, wherein the terminal connecting portions of the terminals are received in the connector housing in parallel so that the press-contacting blades are arranged in a staggered manner, wherein the interconnecting portion has a press-contact receiving face which abuts against an inner wall of the connector housing so that a press-contacting force acting on the press-contacting blade is received by the inner wall of the connector housing when the wire is press-contacted with the press-contacting blade, and wherein the connector housing has a support jig-inserting portion into which a support jig for receiving the press-contacting force through the inner wall of the connector housing is inserted.

4. The connector as set forth in claim 3, wherein the press-contact receiving face is formed at a rear side of the press-contacting blade.

5. The connector as set forth in claim 3, wherein the press-contacting blade is formed by a flat plate having a groove with which the wire is press-contacted.

6. The connector as set forth in claim 3, wherein the wire press-contacting portion is spaced a prescribed distance from the terminal connecting portion in a direction perpendicular to the press-contacting direction.

7. The connector as set forth in claim 3, wherein the press-contacting blade has a planar face which is positioned above the terminal connecting portion in a direction perpendicular to the press-contacting direction.

* * * * *